US011898292B2

(12) United States Patent
Uetsuhara et al.

(10) Patent No.: US 11,898,292 B2
(45) Date of Patent: Feb. 13, 2024

(54) WASHING MACHINE

(71) Applicant: SAMSUNG ELECTRONICS CO., LTD., Suwon-si (KR)

(72) Inventors: Masahiro Uetsuhara, Yokohama (JP); Tomoyuki Okuno, Yokohama (JP); Katsuyuki Shimakage, Kanagawa (JP); Kiyonobu Yoshida, Yokohama (JP); Yasushi Urai, Yokohama (JP); Takehiro Nakanishi, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 140 days.

(21) Appl. No.: 17/415,975

(22) PCT Filed: Dec. 16, 2019

(86) PCT No.: PCT/KR2019/017787
§ 371 (c)(1),
(2) Date: Jun. 18, 2021

(87) PCT Pub. No.: WO2020/130523
PCT Pub. Date: Jun. 25, 2020

(65) Prior Publication Data

US 2021/0381153 A1 Dec. 9, 2021

(30) Foreign Application Priority Data

Dec. 18, 2018 (JP) ..... 2018-236289
Apr. 16, 2019 (JP) ..... 2019-077744
(Continued)

(51) Int. Cl.
*D06F 37/06* (2006.01)
*D06F 37/30* (2020.01)
(Continued)

(52) U.S. Cl.
CPC ..... *D06F 37/06* (2013.01); *D06F 37/04* (2013.01); *D06F 37/30* (2013.01); *D06F 39/083* (2013.01);
(Continued)

(58) Field of Classification Search
CPC ..... D06F 37/04; D06F 37/06; D06F 37/065
See application file for complete search history.

(56) References Cited

U.S. PATENT DOCUMENTS

2008/0271498 A1* 11/2008 Czyzewski ..... D06F 23/06 68/139
2008/0302140 A1* 12/2008 Jeong ..... D06F 37/02 68/142
(Continued)

FOREIGN PATENT DOCUMENTS

CN 1651634 A 8/2005
CN 103649399 A 3/2014
(Continued)

OTHER PUBLICATIONS

Machine translation of JP-2008237646-A. (Year: 2008).*
(Continued)

*Primary Examiner* — Joseph L. Perrin
(74) *Attorney, Agent, or Firm* — STAAS & HALSEY LLP

(57) ABSTRACT

Disclosed herein is a drum type washing machine capable of obtaining a high-water saving effect. The drum type washing machine comprises at least one processor configured to control a drive device configured to rotate a drum, a water supplier configured to supply water to a tub, and a sprinkler configured to spray water stored in the tub toward laundry accommodated in the drum. The drum comprises a lifter and a plurality of rear through-holes. The at least one processor is configured to perform a water spray process while rotating
(Continued)

the drum in a state in which an amount of wash water absorbable by the laundry is maintained in the tub, in a washing cycle. In the water spray process, a waiting process, in which driving a circulation pump 91 is stopped, is intermittently and repeatedly performed.

9 Claims, 24 Drawing Sheets

(30) Foreign Application Priority Data

Jul. 29, 2019 (JP) ..... 2019-139119
Dec. 13, 2019 (KR) ..... 10-2019-0166720

(51) Int. Cl.

| | |
|---|---|
| ***D06F 39/08*** | (2006.01) |
| ***D06F 37/04*** | (2006.01) |
| *D06F 103/18* | (2020.01) |
| *D06F 33/36* | (2020.01) |
| *D06F 105/06* | (2020.01) |
| *D06F 23/06* | (2006.01) |

(52) U.S. Cl.
CPC ..... *D06F 23/065* (2013.01); *D06F 33/36* (2020.02); *D06F 39/087* (2013.01); *D06F 2103/18* (2020.02); *D06F 2105/06* (2020.02)

(56) References Cited

U.S. PATENT DOCUMENTS

| | | | | |
|---|---|---|---|---|
| 2011/0100068 | A1* | 5/2011 | Simsek | D06F 37/266 68/19 |
| 2013/0081432 | A1 | 4/2013 | Choi et al. | |
| 2020/0248363 | A1* | 8/2020 | Seo | D06F 21/10 |
| 2021/0269961 | A1* | 9/2021 | Jones | D06F 37/06 |
| 2022/0106725 | A1* | 4/2022 | Simsek | D06B 11/0096 |
| 2022/0356628 | A1* | 11/2022 | Jones | D06F 37/06 |

FOREIGN PATENT DOCUMENTS

| | | | |
|---|---|---|---|
| CN | 205258882 | U | 5/2016 |
| CN | 710 594 | A1 | 7/2016 |
| EP | 2 434 040 | A2 | 3/2012 |
| EP | 2 363 523 | B1 | 5/2014 |
| EP | 2 754 743 | A1 | 7/2014 |
| EP | 2 728 048 | B1 | 1/2017 |
| JP | 2008-220505 | A | 9/2008 |
| JP | 2008-237646 | A | 10/2008 |
| JP | 2008237646 | A * | 10/2008 |
| JP | 2010-46124 | A | 3/2010 |
| JP | 2016-187450 | A | 11/2016 |
| JP | 2017-99723 | A | 6/2017 |
| KR | 10-2008-0003630 | A | 1/2008 |
| WO | WO 2008/125974 | A2 | 10/2008 |
| WO | WO 2008/125974 | A3 | 10/2008 |
| WO | WO 2013/073140 | A1 | 5/2013 |

OTHER PUBLICATIONS

International Search Report dated Apr. 14, 2020, in corresponding International Patent Application No. PCT/KR2019/017787.
Office Action dated Aug. 17, 2022, issued in Chinese Application No. 201980084859.6.
European Search Report dated Dec. 17, 2021 in Application No. EP 19 90 0033.
Office Action dated Feb. 23, 2022 in India Application No. 202117029851.
Office Action dated Jan. 19, 2023, in Chinese Application No. 201980084859.6.
Office Action dated Oct. 6, 2023, in European Application No. 19 900 033.2.

* cited by examiner

WASHING MACHINE

CROSS-REFERENCE TO RELATED APPLICATIONS

This application is a U.S. National Stage Application which claims the benefit under 35 U.S.C. § 371 of International Patent Application No. PCT/KR2019/017787 filed on Dec. 16, 2019, which claims foreign priority benefit under 35 U.S.C. § 119 of Korean Patent Application 10-2019-0166720 filed on Dec. 13, 2019, in the Korean Intellectual Property Office, and Japanese Patent Application 2019-139119 filed on Jul. 29, 2019, Japanese Patent Application No. 2019-077744 filed on Apr. 16, 2019, and Japanese Patent Application No. 2018-236289 filed on Dec. 18, 2018, in the Japanese Intellectual Property Office, the contents of which are incorporated herein by reference.

TECHNICAL FIELD

The present disclosure relates to a washing machine, and more particularly, to a washing machine having improved water and energy saving effect, and improved washing performance.

BACKGROUND ART

A drum-type washing machine in which a water-saving effect is improved by increasing water stored in a drum than water stored in a water tub was disclosed (Patent Documents 1 and 2).

The drum-type washing machine, unlike a conventional drum-type washing machine, is provided in such a way that a large number of small holes, which is usually formed on a circumferential wall or a bottom wall of the drum, is formed on only a part of the drum, making it difficult for water to be discharged from the inside of the drum (hereinafter referred to as the "hole-less type"). Further, by including a circulation device configured to circulate water stored in the water tub to the drum, the drum-type washing machine adjusts an amount of circulating water so that a relatively large amount of water is maintained in the drum during a washing cycle.

Although it is not a hole-less drum-type washing machine, the present applicant has previously proposed a drum-type washing machine in which a plurality of concave and convex structures extending in a circumferential direction is formed on an entire circumferential wall of a drum in order to improve the strength and spin-drying performance of the drum (Patent Document 3)

Patent Document 1: Japanese Patent Laid-Open Publication No. 2008-220505

Patent document 2: Japanese Patent Laid-Open No. 2008-237646

Patent Document 3: Japanese Patent Laid-Open No. 2017-99723.

DISCLOSURE

Technical Problem

Because a total amount of water stored in a water tub and a drum is reduced in comparison with the conventional drum-type washing machine, the above-described hole-less-drum-type washing machine has an improved water-saving effect.

However, because a certain amount of water is stored on both sides of the water tub and the drum, there is water that does not contribute to washing among the total amount of water during washing.

In addition, because the drum is rotated while water is stored in the drum, energy to lift the water is required. As a result, the rotational energy increases, and thus the total amount of energy required for washing increases.

Moreover, in the drum-type washing and drying machine of Patent Documents 1 and 2, because drainage is performed only through a group of small holes provided at the bottom of the drum, a drainage performance is poor and it takes time for spin-drying. Therefore, there is a difficulty in terms of spin-drying performance.

The present disclosure is directed to providing a drum-type washing machine capable of reducing a total amount of water used for washing to an extreme, thereby obtaining a high-water saving effect, a high washing performance and energy saving effect.

Further, the present disclosure is directed to providing a hole-less-drum-type washing machine having an excellent spin-drying performance as well as having a water and energy saving effect.

Technical Solution

One aspect of the present disclosure provides a drum-type washing machine including a main body including an inlet through which laundry is inserted and withdrawn, a tub installed inside the main body in a state in which an opening is connected to the inlet, and a drum rotatably accommodated in the tub in a state in which the opening faces the inlet, a drive device configured to drive the drum to be rotatable, a water supplier configured to supply water to an inside of the tub, a sprinkler configured to spray water toward the laundry accommodated in the drum by delivering water stored in the tub to a circulation pump, and a control device configured to control the drive device, the water supplier, and the sprinkler.

The drum may include a lifter protruding inward from an inner surface of the circumferential wall, and a plurality of rear through holes formed at a rear end portion of the circumferential wall. In a washing cycle, the control device may perform a water spray process, which is to spray wash water to an inside of the drum while rotating the drum in a state of maintaining the wash water that is an amount of water absorbable by the laundry in the tub, and the control device may intermittently repeatedly perform a waiting process, in which driving of the circulation pump is stopped, until the wash water, which is discharged from the rear through hole in the water spray process, is stored in the tub and the stored water is able to be delivered.

In the drum-type washing machine, the lifter may be provided in the drum configured to be rotated while accommodating the laundry, as in a conventional drum-type washing machine, and in the washing cycle, laundry may be mainly washed by "beating-washing" described later.

In addition, because the sprinkler configured to spray water to laundry accommodated in the drum is provided, the water spray process for spraying wash water to the inside of the drum while rotating the drum in a state of maintaining the amount of wash water absorbable by the laundry, that is an amount of wash water for sufficiently wetting the laundry, in the tub may be performed in the washing cycle.

In other words, a small amount of wash water is maintained inside the tub, and most of this small amount of wash water is not wasted and thus it is possible efficiently wet the laundry. Because most of the sprayed water is absorbed and maintained by the laundry, almost no wash water may be stored inside the drum.

Therefore, as described later, because the laundry becomes sufficiently heavy and a fall distance is increased, a washing effect may be improved by receiving a strong impact force. Because the falling laundry is supported by a circumference, even if the laundry contains a lot of wash water, it is possible to suppress a rapid decrease in a weight of the laundry, thereby stably maintaining an effective beating-washing.

Wash water gradually discharged from the laundry is collected in the tub through the rear through hole. Because there is a small amount of wash water, it is difficult to continuously perform the water spray process. Accordingly, in the drum-type washing machine, the waiting process, in which driving of the circulation pump is stopped until the amount of water stored in the tub becomes an amount of water that is deliverable, may be intermittently repeatedly performed. Accordingly, it is possible to stably perform the water spray process even if there is a small amount of wash water.

Because there is a small amount of wash water, it is possible to reduce a period of time required for a process such as water supply or drainage. Because it is possible to reduce a capability of the related device, the cost of subsidiary materials may also be reduced.

In addition, the drum of the drum type washing machine may further include a plurality of front through holes formed at a front end portion of the circumferential wall.

In the case of spin-drying, the spin-drying may be efficiently performed because the wash water is discharged through the front through hole.

In addition, in the drum-type washing machine, the drum may include a plurality of protruding ribs protruding inward from the circumferential wall and extending in a circumferential direction. The plurality of protruding ribs may be divided, and thus a water flow path provided to allow water to flow along the inner surface of the circumferential wall may be formed between the front through hole and the rear through hole.

The plurality of protruding ribs extending in the circumferential direction may be provided on the circumferential wall of the drum. Therefore, it is possible to improve the strength and spin-drying performance of the drum. However, in a case in which a protruding rib extending in the circumferential direction is formed in a portion of the circumferential wall without holes, water pushed against the circumferential wall of the drum by centrifugal force in the spin-drying may be collected between the protruding ribs and thus may be not smoothly discharged.

On the other hand, in the drum type washing machine, the protruding rib is divided, thereby forming the water flow path between the front through hole and the rear through hole to allow water to flow along the inner surface of the circumferential wall. Accordingly, because water collected between the protruding ribs flows along the water flow path and flows out from the front through hole to the rear through hole, the water may be discharged smoothly. Therefore, good spin-drying performance may be obtained.

In the drum type washing machine, a plurality of water flow paths substantially perpendicular to the protruding ribs and extending in a straight line from the front end portion to the rear end portion of the circumferential wall may be formed in the circumferential wall.

Therefore, because it is possible to more smoothly discharge the water during the spin-drying, the spin-drying performance may be further improved.

In the drum-type washing machine, an end surface of the protruding rib may be inclined at an angle of 20° or more with respect to the inner surface of the circumferential wall.

Accordingly, even if the laundry is strongly pushed against the circumferential wall during the spin-drying, the water flow path may be stably secured. In addition, because the laundry is well squeezed by increasing a contact angle, an excellent spin-drying effect may be obtained even in a hole-less type drum.

The drum type washing machine may also be provided in a form in which at least one inner surface of the front end portion including the front through hole and the rear end portion including the rear through hole of the circumferential wall is recessed.

Because the vicinity of the front through hole is relatively recessed, the water flowing along the water flow path is easy to flow out of the through hole. Therefore, good drainage properties may be obtained.

In the drum-type washing machine, because the water flow path is formed along each of the opposite side portions of the lifter, and a water guide surface provided to guide water to one of the front through hole and the rear through hole may be formed as the side portion is inclined with respect to an axial direction.

During the spin-drying, the water flowing in the circumferential direction along the circumferential wall of the drum is blocked by the lifter. Even if the laundry sticks to the circumferential wall during the spin-drying, the laundry is supported by a protruding end of the lifter. In response to that the water flow path is formed along the side portion of the lifter, a relatively large space is formed above the water flow path.

Therefore, it is possible to smoothly guide a large amount of water, which is blocked by the lifter, to the front through hole or the rear through hole. In response to that the water guide surface is formed on each side portion of the lifter, water may be guided by selecting the front through hole or the rear through hole, and thus water may be discharged more effectively.

In the drum type washing machine, the lifter may include a plurality of mounting hooks and the circumferential wall may include a plurality of mounting holes opened to be larger than the mounting hook and provided to allow the mounting hook to be mounted thereto. As the mounting hook is mounted to the mounting hole, the lifter may be mounted to the inner surface of the circumferential wall, and a water through hole provided to allow water to flow into the lifter may be formed on each side portion of the lifter.

Accordingly, drainage performance may be further improved because drainage is performed using the mounting hole used for mounting the lifter along with the front through hole and the rear through hole. Therefore, it is possible to further increase the spin-drying performance.

In the drum-type washing machine, a reinforcing protrusion extending in the circumferential direction may be formed in a portion between the front end portion of the lifter and the front through hole of the circumferential wall, and a portion between the rear end portion of the lifter and the rear through hole of the circumferential wall.

The circumferential wall is reinforced by the protruding portion, but there are no protruding ribs around the lifter. Accordingly, a difference in strength occurs in the circumferential direction of the circumferential wall. Therefore, during bending the circumferential wall, there is a difficulty that deformation easily occurs and it is difficult to obtain roundness, and there is a difficulty that stress concentration occurs during use, and thus the drum is easily deformed.

On the other hand, by providing the reinforcing protrusions, the difference in strength in the circumferential direction of the circumferential wall may be reduced, thereby solving this difficulty.

In the drum-type washing machine, the sprinkler may include a sprinkling port provided to spray water from above the opening of the drum toward the bottom of the drum.

Accordingly, it is possible to evenly spray wash water to the laundry accommodated in the drum. Therefore, it is possible to sufficiently wet the laundry in a short time without wasting even a small amount of wash water.

In the drum-type washing machine, a tray-shaped water reservoir recessed downward may be provided in a lower portion of the tub, and wash water discharged through the rear through hole may be collected in the water reservoir.

Accordingly, small amount of water maintained inside the tub may be collected and stored smoothly in a short time. Even when water is collected in the tub, it is difficult for the water to be in contact with the drum. Accordingly, it becomes difficult for water collected in the tub to flow into the drum, and a diameter of the drum may be increased, thereby increasing the washing effect. In response to reducing a volume of the water reservoir, the diameter of the drum may be increased by utilizing effective dimensions as much.

The drum-type washing machine may include a water level sensor configured to detect a level of water stored in the tub and output the detected water level to the control device.

Accordingly, even when there is a small amount of wash water, it is possible to automatically perform the water spray process and the waiting process by switching a timing, appropriately, based on the detected value of the water level sensor.

In this case, a heater controlled by the control device may be installed inside the water reservoir.

If wash water is heated, the washing effect may be increased. Because there is a small amount of wash water, a heating time may be reduced and power consumption may be suppressed. The waiting process for stopping the circulation pump may be performed and a water level may be detected by the water level sensor. Accordingly, even if there is the small amount of wash water, it is possible to prevent that heating is performed through the heater without water.

In the drum-type washing machine, a cover portion protruding to an upper side of the water reservoir may be provided along an edge of a side portion of the water reservoir that is located on an advancing side of a spin-drying rotation direction of the drum.

In the spin-drying, the drum is rotated at high speed. At this time, by providing the cover portion, it is possible to prevent the water, which is blown from the rear through hole, from being rolled and it is possible to drop the water to the water reservoir.

In the drum-type washing machine, the control device may perform a laundry weight measurement process for measuring a weight of the laundry accommodated in the drum, prior to the washing cycle, and the control device may control an amount of water corresponding to the weight of the laundry to be supplied to the tub.

Although the weight of laundry varies, it is possible to supply the amount of water corresponding to the weight of laundry, and thus it is possible to save water at a high level.

In this case, the amount of water supplied to the tub may be set based on the amount of water absorbable by the laundry and the amount of water that the circulation pump is able to deliver.

Accordingly, the high level of water saving may be realized because water provided for washing is reduced to the extreme while securing a high washing effect.

The drum-type washing machine may further include a drying device configured to circulate warm air in the drum, based on the control of the control device. The drum may further include a plurality of through holes in a bottom wall thereof, and a total opening area of the through holes may be greater than a total opening area of the front through hole and the rear through hole.

That is, in a drum type washing and drying machine to which the technology according to the embodiment is applied, in response to that the plurality of through holes is formed in the bottom wall of the drum, and the total opening area of the through holes is greater than the total opening area of the front through hole and the rear through hole, it is possible to efficiently dry the laundry. Because a drying time is reduced and power consumption is reduced, energy saving may be realized more effectively.

Another aspect of the present disclosure provides a washing machine including a main body, a tub installed inside the main body to store water, a drum rotatably disposed on the tub to accommodate laundry, a drive device configured to rotate the drum, a water supplier configured to supply water to the tub, a sprinkler configured to spray water toward the laundry accommodated in the drum by pumping water stored in the tub to a circulation pump, and at least one processor configured to control the drive device, the water supplier, and the sprinkler. The drum includes a circumferential wall, a lifter protruding from an inner surface of the circumferential wall, and a plurality of rear through-holes formed at a rear end portion of the circumferential wall. The at least one processor is configured to perform a water spray process, which is to drive the circulation pump to allow water, which is stored in the tub, to be sprayed to the laundry accommodated in the drum while rotating the drum, in a washing cycle, and configured to intermittently and repeatedly perform a waiting process in which driving of the circulation pump is stopped during the water spray process.

In response to that an amount of water stored in the tub is reduced to a first amount of water that the circulation pump is unable to deliver during the water spray process, the at least one processor may stop the water spray process until the water of the drum is discharged to the tub through the rear through hole and the water stored in the tub is increased to a second amount of water that the circulation pump is able to deliver.

The washing machine may further include a water level sensor configured to detect a level of water stored in the tub and configured to output the detected water level to the at least one processor.

The water level sensor may detect a reference water level, which corresponds to the second amount of water that the circulation pump is able to deliver, to the at least one processor.

The at least one processor may determine whether a predetermined time elapses since the tub is at the reference water level, so as to determine whether an amount of water stored in the tub reaches the first amount of water that the circulation pump is unable to deliver.

An amount of water supplied to the tub by the water supplier may be set based on the second amount of water that the circulation pump is able to deliver and a third amount of water absorbable by the laundry.

Prior to the washing cycle, the at least one processor may perform a laundry weight measurement process, which is to measure a weight of the laundry accommodated in the drum, and determine the third amount of water absorbable by the laundry based on the weight of the laundry.

The tub may include a water reservoir recessed downward in a lower portion of the tub, so as to collect water flowing out through the rear through-hole.

The drum may further include a plurality of front through holes formed at a front end portion of the circumferential wall.

The drum may further include a plurality of protruding ribs protruding from an inner surface of the circumferential wall and extending in a circumferential direction to form a water flow path provided between the front through hole and the rear through hole so as to allow water to flow along the inner surface of the circumferential wall.

Another aspect of the present disclosure provides a washing machine including a main body, a tub installed inside the main body to store water, a drum rotatably disposed on the tub to accommodate laundry, and a sprinkler configured to spray water toward the laundry accommodated in the drum by pumping water stored in the tub to a circulation pump. The drum includes a circumferential wall, a lifter protruding from an inner surface of the circumferential wall, a plurality of front through holes formed at a front end portion of the circumferential wall, a plurality of rear through holes formed at a rear end portion of the circumferential wall, and a plurality of protruding ribs protruding from the inner surface of the circumferential wall and extending in a circumferential direction to form a water flow path provided between the front through hole and the rear through hole so as to allow water to flow along the inner surface of the circumferential wall.

A concave groove portion provided to extend in the circumferential direction and formed in such a way that the circumferential wall protrudes to an outside and the inner surface of the circumferential wall is relatively recessed, may be formed in the front and rear end portion of the circumferential wall. The front through hole may be formed in the front concave groove portion, and the rear through hole may be formed in the rear concave groove portion.

The plurality of protruding ribs may be installed in a range of the circumferential wall excluding a lifter installation portion, in which the lifter is installed, the front concave groove portion and the rear concave groove portion.

The plurality of protruding ribs may be formed to be spaced apart from each other in the circumferential direction, and the water flow path may be formed along an axial direction between the plurality of protruding ribs adjacent along the circumferential direction.

The plurality of protruding ribs may be formed to be spaced apart from each other in an axial direction, and an annular flow path may be formed along the circumferential direction between the plurality of protruding ribs adjacent along the axial direction.

Circumferential opposite end surfaces of the plurality of protruding ribs and axial opposite end surfaces of the plurality of protruding ribs may be inclined at a predetermined angle with respect to the inner surface of the circumferential wall.

Another aspect of the present disclosure provides a washing machine including a main body, a tub installed inside the main body to store water, a drum rotatably disposed on the tub to accommodate laundry, and a sprinkler configured to spray water toward the laundry accommodated in the drum by pumping water stored in the tub to a circulation pump. The drum includes a circumferential wall, a lifter protruding from an inner surface of the circumferential wall and extending in an axial direction, a plurality of front through holes formed at a front end portion of the circumferential wall, and a plurality of rear through holes formed at a rear end portion of the circumferential wall. The lifter includes a water guide surface formed on opposite sides of the lifter to guide water into one of the front through hole and the rear through hole.

The lifter may include a water through hole formed on the water guide surface to introduce water into the lifter.

The lifter may include a mounting hook to be mounted on the circumferential wall, and a mounting hole to which the mounting hook is mounted may be formed on the circumferential wall. The mounting hole may include an opening to allow water in the lift to escape to an outside of the drum in a state in which the mounting hook is mounted.

The drum may further include a reinforcing protrusion formed in the circumferential direction between a front end portion of the lifter and the front through hole of the circumferential wall and between a rear portion of the lifter and the rear through hole of the circumferential wall.

Advantageous Effects

It is possible to implement a drum type washing machine capable of obtaining a high-water saving effect because a total amount of water used for washing is greatly reduced. It is possible to improve spin-drying performance.

MODES OF THE INVENTION

Hereinafter embodiments of the present disclosure will be described in detail with reference to the drawings. However, the following description is essentially merely an example, and does not limit the present disclosure, its applications, or its use. In addition, an axial direction used in the description means a direction in which a horizontal axis J is extended. Similarly, a circumferential direction refers to a direction round the horizontal axis J.

<Summary of Drum Type Washing Machine>

A drum-type washing machine (simply referred to as the "washing machine"), to which a technology according to embodiments is applied, is provided to reduce an amount of water, which is to use for a washing cycle, as possible, in consideration of a mechanical action that contributes to a washing effect.

Figure 1:
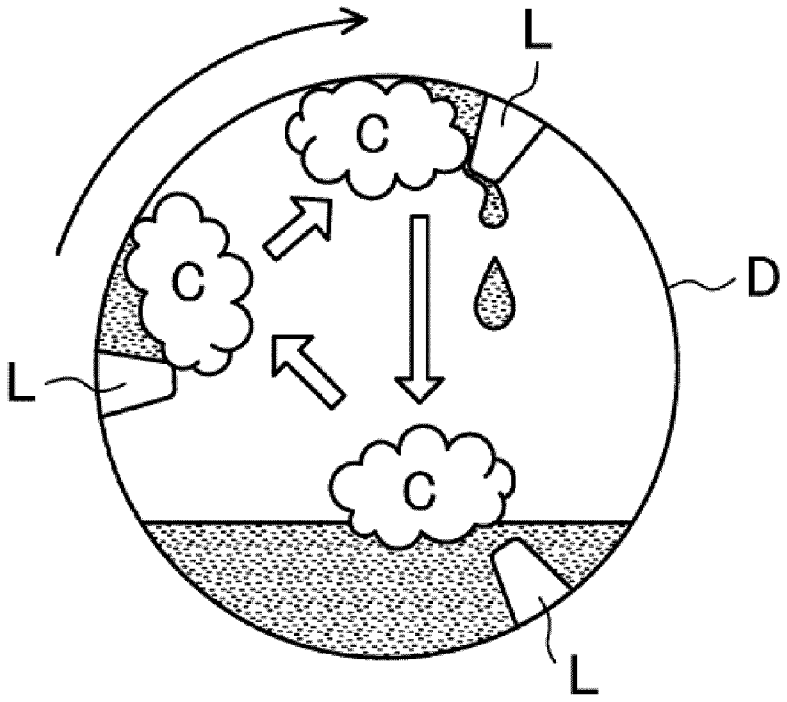
FIG. 1 is a view illustrating a washing mechanism of a conventional drum type washing machine.

As shown in FIG. 1, in a conventional drum type washing machine, a plurality of lifters L is installed inside a drum D. In the washing cycle, a predetermined amount of detergent and water (wash water) are supplied to the inside of the drum D, and the drum D is driven to rotate in that state. Accordingly, clothes C corresponding to laundry soaked in wash water is repeatedly pushed up and dropped by the lifter L.

That is, in the case of the drum-type washing machine, washing may be performed mainly by a mechanical action in which the clothes C wet with wash water falls (it is referred as "beating-washing"). Accordingly, the washing effect of the drum-type washing machine is greatly influenced by an impact force upon falling of the clothes C.

Based on an inner diameter of the drum D being large, a fall distance increases. Therefore, in order to increase the washing effect, it is appropriate that the inner diameter of the drum D is large. In a case in which the inner diameter of the drum D is the same, the impact force is increased when a weight of the clothes C, that is, a large amount of wash water, is contained, and thus the washing effect may be increased. Further, in a state in which a small amount of wash water is contained in the drum D, the fall distance is increased and impact relaxation by water is also reduced, and thus the washing effect may be increased.

In a case in which water is stored in the drum D, the water is also lifted, and thus extra energy is consumed for the rotation of the drum D. Therefore, in terms of an energy saving effect, it is appropriate that an amount of water inside the drum D is less.

Therefore, the washing machine is provided in such a way that in the washing cycle, the clothes C is sufficiently wet to maximize a weight thereof and at the same time, wash water is prevented from being stored in the drum, thereby maximizing the fall distance, and allowing the clothes to directly collide against a wall of the drum, and thus the washing effect is increased.

Accordingly, a total amount of water used for washing may be reduced as much as possible, and a high-water saving effect may be obtained. In addition, because the total amount of water is reduced, a time required for an operation such as water supply or drainage may be reduced, and it is possible to reduce the capacity of related devices, and thus the cost of subsidiary materials may be reduced. Because the energy consumed for lifting water is suppressed, an energy saving effect may be obtained.

In addition, in the washing machine, a process, in which water is intermittently sprayed to the drum, is performed during the washing cycle. At this time, the drum may be rotated in a state in which no water is stored between the drum and the tub. Accordingly, because a rotational resistance that the rotating drum receives from water is reduced, a higher energy saving effect may be obtained.

First Embodiment

<Structure of Washing Machine>

Figure 2:
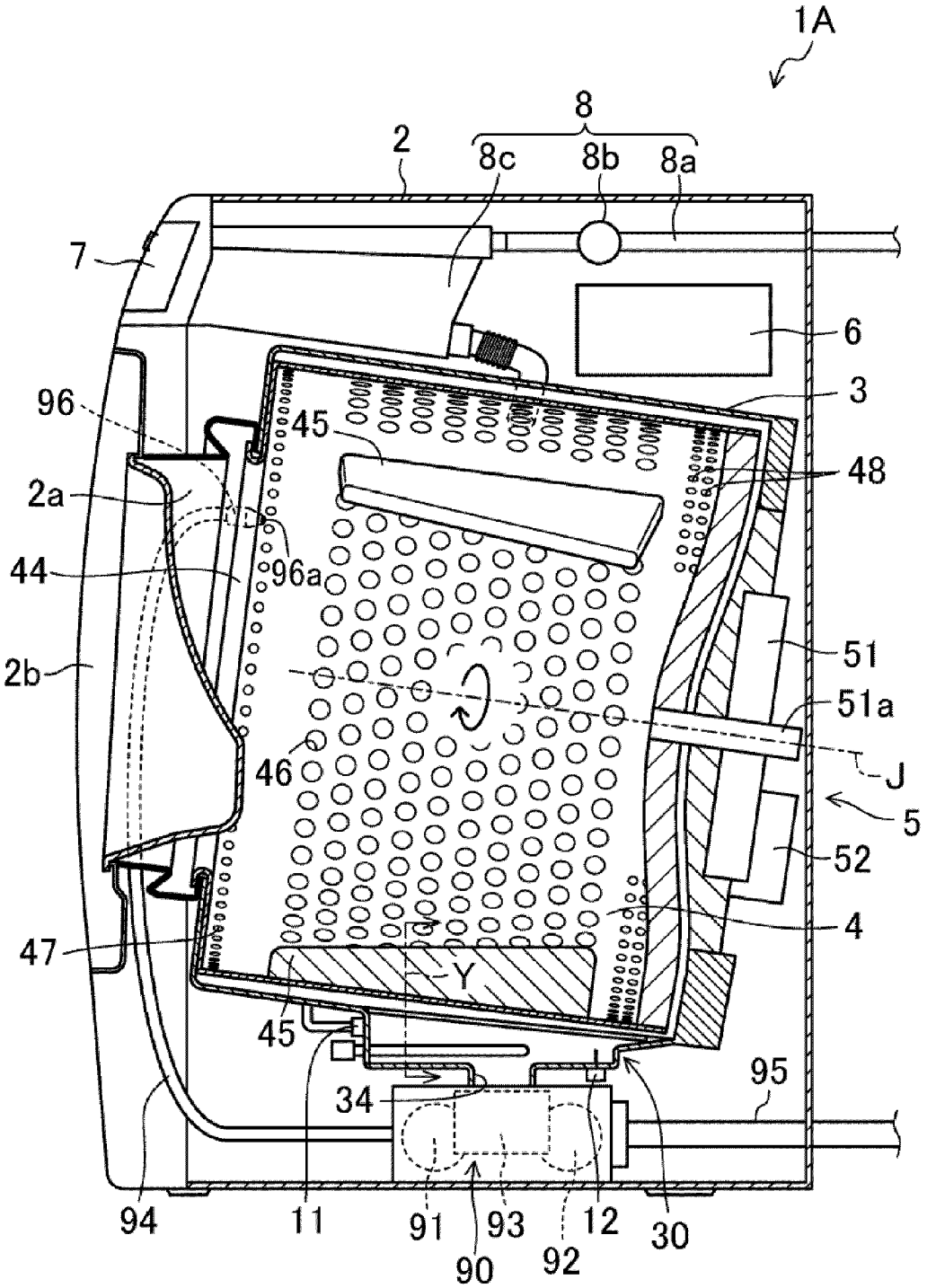
FIG. 2 is schematic view illustrating a main structure of a drum type washing machine according to a first embodiment of the present disclosure.

FIG. 2 illustrates an example of a drum type washing machine (washing machine 1A) to which a technology according to embodiments is applied. The washing machine 1A is mainly composed of a main body 2, a tub 3, a drum 4, a drive device 5, a controller 6 (an example of a control device), and the like.

In the washing machine 1A, the drum 4 containing laundry is rotated about a horizontal axis J (an axis extending approximately in a horizontal direction or in an inclined direction). In addition, the washing machine 1A is a so-called fully automatic drum type washing machine, and is configured to automatically perform a series of washing operation including washing, rinsing, and spin-drying cycles.

(Main Body)

The main body 2 is a box-shaped container composed of panels or frames, and forms an outer periphery of the washing machine 1A. A circular inlet 2*a* is formed on a front side of the main body 2 to allow laundry to be inserted or withdrawn. A door 2*b* including a transparent window is installed in the inlet 2*a*. The inlet 2*a* is opened and closed by the door 2*b*. On the upper side of the inlet 2*a* of the main body 2, a manipulator 7 including a switch operated by a user is provided.

(Tub 3)

Inside the main body 2, the tub 3 provided to communicate with the inlet 2*a* is installed. The tub 3 is provided with a bottomed cylindrical container provided to store water, and an opening thereof is connected to the inlet 2*a*. The tub 3 is supported by a damper (not shown) provided inside the main body 2, and the horizontal axis J may pass through a center of the tub 3.

A water supplier 8 including a water supply pipe 8*a*, a water supply valve 8*b*, and a detergent dispenser 8*c* is provided above the tub 3. An upstream end of the water supply pipe 8*a* protrudes to the outside of the washing machine 1A and is connected to an external water supply source. A downstream end of the water supply pipe 8*a* is connected to a water supply port 3*a* provided to be opened to an upper side of the tub 3.

The detergent dispenser 8*c* is provided to accommodate a detergent such as a detergent or a softener, and configured to be inserted into or withdrawn from the main body 2. Before washing, detergent may be put into the detergent dispenser 8*c*. Accordingly, the detergent dispenser 8*c* mixes the received detergent with water to be supplied and supplies the mixture to the tub 3.

A tray-shaped water reservoir 30 recessed downward is provided under the tub 3. A water treatment unit 90 functioning as a drainage device and a sprinkler is installed under the tub 3. The water reservoir 30 and the water treatment unit 90 will be separately described later.

(Drum 4)

Figure 3:
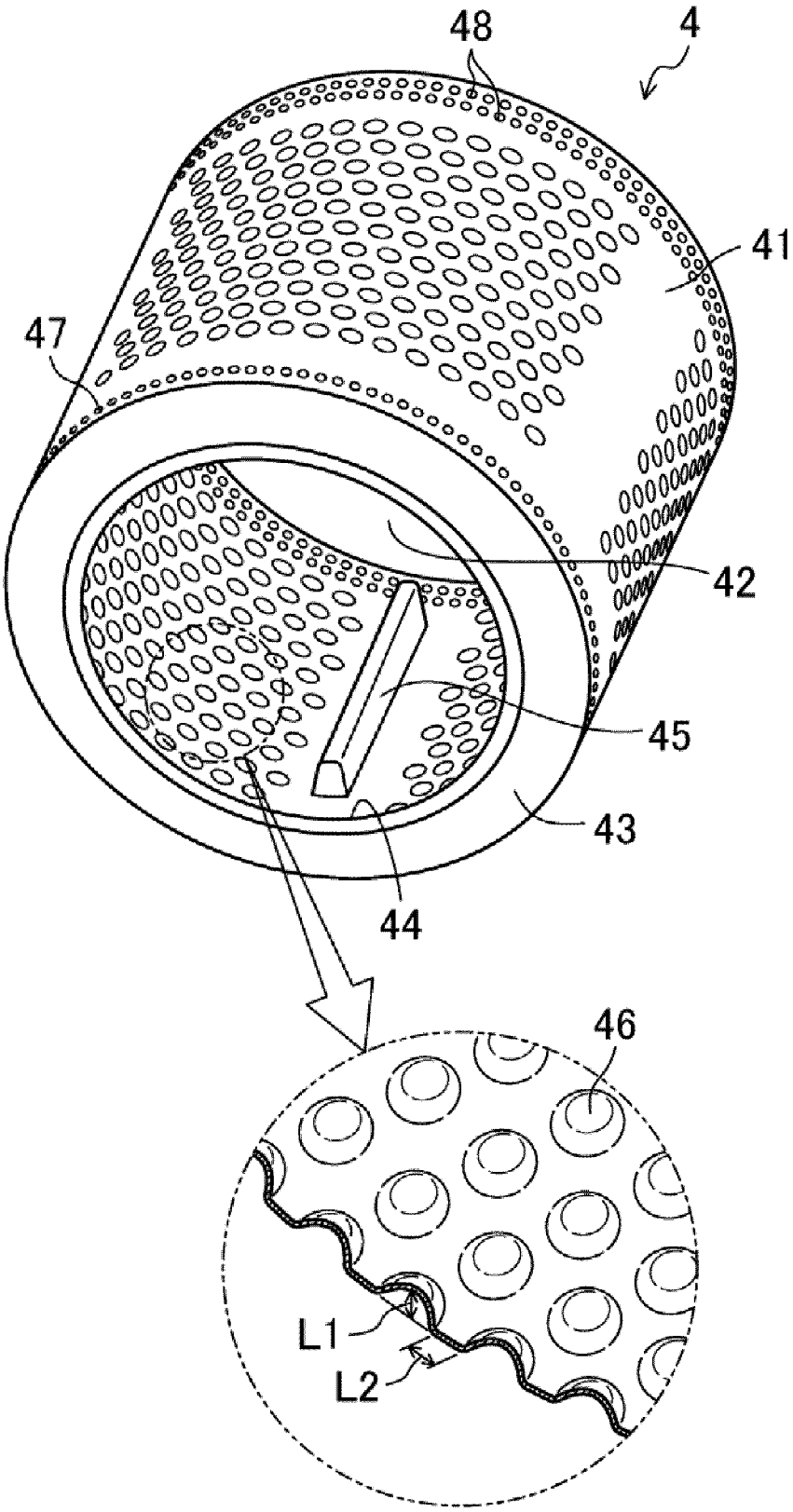
FIG. 3 is a schematic perspective view illustrating a structure of a drum according to the first embodiment of the present disclosure, and an enlarged view of a concave portion of the drum.

The drum 4 is provided with a cylindrical container having a diameter slightly smaller than that of the tub 3, and is accommodated in the tub 3 in such a way that a center of the drum 4 is aligned with the center of the tub 3 and a bottom of the drum 4 faces the rear side. As shown in FIG. 3, the drum 4 includes a cylindrical circumferential wall 41, a disk-shaped bottom wall 42 provided to cover the bottom, and a flange wall 43 formed in a circular ring shape and provided to protrude from an edge of the opening side to an inward direction. The circumferential wall 41 is formed by pressing a steel plate.

Accordingly, a circular opening 44 corresponding to the inlet 2*a* is formed in a front portion of the drum 4. The laundry is put into the drum 4 through the inlet 2*a* and the opening 44. The front portion of the drum 4 is rotatably supported by the inlet 2*a*.

A lifter 45, a protrusion 46, a front through hole 47, and a rear through hole 48, may be provided on the circumferential wall 41 of the drum 4.

The lifter 45 is formed of an elongated member, extends along the center line of the drum 4, and protrudes from an inner surface of the circumferential wall 41 to the inward direction. A plurality of lifters 45 (three in the washing machine 1A) is provided at equal intervals along the circumferential direction of the circumferential wall 41. The shape, arrangement, and number of the lifters 45 may be changed according to specifications.

The protrusion 46 is provided with a protrusion protruding inward on the inner surface of the circumferential wall 41, and a plurality of protrusions 46 is provided on the circumferential wall 41. The protrusion 46 is arranged in a grid shape with an interval between the lifters 45. Each of the protrusions 46 is formed by recessing an outer surface of the circumferential wall 41. Each protrusion 46 is formed in a dome shape with a smooth surface.

A height L1 of each protrusion 46 and a distance L2 between the adjacent protrusions 46 are provided in such a way that a space between the adjacent protrusions 46 is empty in response to that the wet clothes are in contact with the inner surface of the circumferential wall 41. The shape and arrangement of the protrusion 46 may vary according to the specifications.

The front through hole 47 and the rear through hole 48 are holes passing through the circumferential wall 41, respectively. The front through hole 47 is formed to be aligned in a line over the entire circumference of the circumferential wall 41. The rear through hole 48 is formed to be aligned in two rows over the entire circumference of the circumferential wall 41. The front through hole 47 is formed in a vicinity of the opening 44 in the circumferential wall 41, and the rear through hole 48 is formed in a vicinity of the bottom wall 42 in the circumferential wall 41.

That is, the drum 4 includes a through hole formed only in a limited area in the front and rear portion of the circumferential wall 41 (hole-less type), unlike a conventional drum in which a through hole is widely formed in the circumferential wall. Accordingly, the drum 4 includes a structure making it difficult for water to flow out, and allowing water to be easily stored. The number, arrangement, size, and shape of each of the front through hole 47 and the rear through hole 48 may vary according to specifications.

Details will be described later, but the front through hole 47 is mainly used for draining of the drum 4 in the spin-drying cycle, and the rear through hole 48 is mainly used for draining of the drum 4 in the washing and rinsing cycle. Therefore, an opening ratio (ratio of an opening area per unit area) is larger in the rear portion than in the front portion of the drum 4 inclined backward. Further, in the washing machine 1A, the drum 4 is required to have a certain amount of water holding capacity. Therefore, a through hole may be formed on other portions of the circumferential wall 41, but an opening ratio thereof is required to be significantly less than that of the front portion or the rear portion of the circumferential wall 41.

(Drive Device 5)

The drive device 5 is installed on the rear portion of the tub 3. The drive device 5 may include a motor 51, and an inverter 52. A shaft 51*a* of the motor 51 penetrates the rear portion of the tub 3 and protrudes into an inner space of the tub 3. A front end of the shaft 51*a* is fixed to the center of the bottom wall 42 of the drum 4.

That is, the rear portion of the drum 4 is axially supported by the shaft 51*a*, and thus the drive device 5 directly drives the drum 4 (so-called direct drive method). Accordingly, the drum 4 is rotated in a predetermined direction around the horizontal axis J by the driving of the motor 51. The direction of rotation may be any direction, but in the washing machine 1A, the drum 4 is configured to be rotated clockwise when viewed from the front.

(Controller 6)

The controller 6 is installed in the upper portion of the main body 2. The controller 6 comprehensively controls the operation of the washing machine 1A. The controller 6 is composed of hardware such as a CPU and memory, and software such as a control program and various data. The controller 6 may include at least one processor. The processor may be configured to execute program instructions maintained on a memory.

Figure 4:
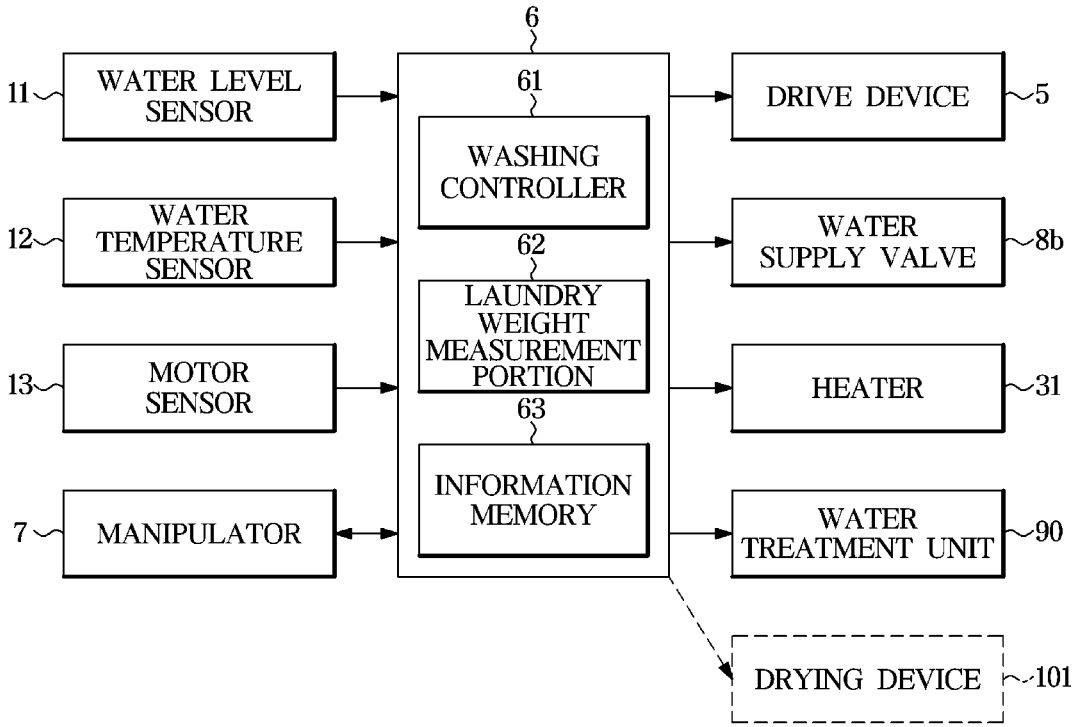
FIG. 4 is a block diagram illustrating a controller and a main configuration of related devices.

FIG. 4 illustrates the controller 6 and main-related devices. The controller 6 is electrically connected to a water level sensor 11, a water temperature sensor 12, a motor sensor 13, the manipulator 7, the drive device 5, the water supply vale 8*b*, a heater 31 and the water treatment unit 90.

The water level sensor 11 detects a level of water stored in the tub 3 and outputs the detected level to the controller 6. As shown in FIG. 2, the water level sensor 11 is installed in the vicinity of the water reservoir 30. The water level sensor 11 detects a level of water stored in the water reservoir 30 based on a change in a water pressure in the water reservoir 30. The water level sensor 11 detects a level of water that is able to be delivered to the circulation pump 91 to be described later (reference water level: in this embodiment, a level of water at which the water reservoir 30 is full) and outputs a result of detection to the controller 6.

The water temperature sensor 12 detects a temperature of water stored in the tub 3 and outputs the detected water temperature to the controller 6. As shown in FIG. 1, the water temperature sensor 12 is installed in the vicinity of the water reservoir 30. Accordingly, the water temperature sensor 12 detects a temperature of water stored in the water reservoir 30. The heater 31 is installed in the water reservoir 30 to heat the water stored in the tub 3.

The motor sensor 13 is embedded in the motor 51 (shown only in FIG. 4), detects the rotational speed of the motor 51, and outputs the detected rotational speed to the controller 6. The manipulator 7 outputs instruction information, which is such as operation start and operation mode selection that is input by the user, to the controller 6. The controller 6 controls the drive device 5, the water supply valve 8*b*, the heater 31, and the water treatment unit 90 based on the measured values and instruction information.

The controller 6 may include a washing controller 61, a laundry weight measurement portion 62, and an information memory 63. The washing controller 61 performs a series of washing operation including washing, rinsing, and spin-drying cycles according to an instruction. The laundry weight measurement portion 62 performs a process of measuring the weight of the laundry accommodated in the drum 4 (laundry weight measurement process). The information memory 63 memorizes information necessary for the washing operation or the laundry weight measurement process, and outputs such information to the washing controller 61 or the laundry weight measurement portion 62.

(Water Reservoir 30 and Water Treatment Unit 90)

Figure 5A:
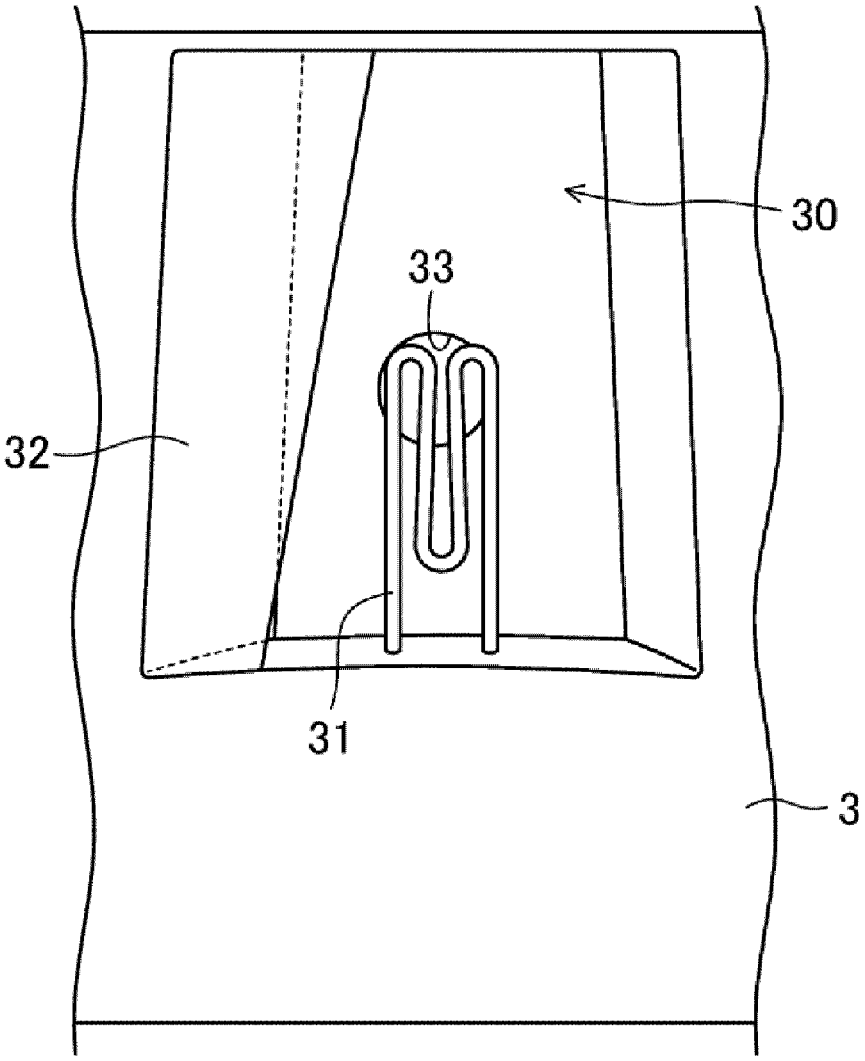
FIG. 5A is a schematic view of a water reservoir viewed from above.
Figure 5B:
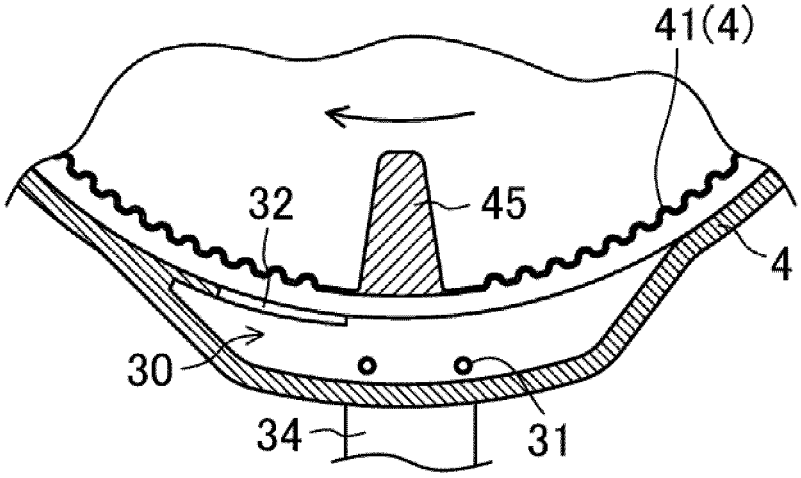
FIG. 5B is a schematic cross-sectional view of the water reservoir taken along an arrow Y in FIG. 2.

The water reservoir 30 is shown in detail in FIGS. 5A and 5B.

As mentioned above, the water reservoir 30 is located in a lower portion of the tub 3, particularly, in a lower side of the lowest rear portion of the tub 3 that is inclined. The water reservoir 30 is formed in a tray shape recessed downward, that is, a shape having a shallow bottom and a relatively large opening area. Accordingly, the water reservoir 30 is provided to efficiently collect and store water, which is discharged through the rear through hole 48. Therefore, even a small amount of water maintained in the tub 3 may be stored smoothly in a short time.

Further, by providing the water reservoir 30 in the tub 3, water stored in the tub 3 may be concentrated in the reservoir 30. As a result, an amount of water stored in portions other than the water reservoir 30 in the tub 3 is reduced. Because it is difficult for water stored in the tub 3 to be in contact with the drum 4, it is possible to increase the diameter of the drum 4. As a result, the washing effect may be improved.

As described above, the heater 31 is provided inside the water reservoir 30. The heater 31 is disposed to extend along a bottom surface of the water reservoir 30. The heater 31 is controlled to be turned on/off by the controller 6, and is converted into a heated state that generates heat and a non-heated state that does not generate heat.

A thin plate-shaped cover portion 32 is provided on a side portion, which is located on an advancing side of the drum 4 in the rotational direction (indicated by an arrow in FIG. 5B), between opposite side portions of the water reservoir 30 facing in the circumferential direction. The cover portion 32 is provided along an edge of the side portion of the water reservoir 30 and protrudes above the water reservoir 30.

In the spin-drying cycle, the drum 4 is rotated at high speed. At this time, by providing the cover portion 32, it is possible to prevent the water, which is blown from the rear through hole 48, from being rolled into the drum 4. In addition, by the cover portion 32, the water blown from the rear through hole 48 may be dropped into the water reservoir 30.

A water port 33 is opened on the bottom surface of the water reservoir 30. The water port 33 is connected to the water treatment unit 90 through a water pipe 34.

The water treatment unit 90 may be formed by integrating the circulation pump 91, a drain pump 92, and a filter 93. The water treatment unit 90 includes a water supply pipe 94 and a drain pipe 95, and, as described above, the water treatment unit 90 functions as a drainage device and a sprinkler. Water introduced into the water treatment unit 90 passes through the filter 93. Accordingly, foreign substances such as buttons, and seams contained in water are filtered out by the filter 93.

Each of the circulation pump 91 and the drain pump 92 is controlled by the controller 6. By driving the circulation pump 91 or the drain pump 92, the water stored in the tub 3 is introduced into the water treatment unit 90 through the water port 33, and after passing through the filter 93, the water is delivered from the water treatment unit 90.

An outlet of the circulation pump 91 is connected to the water supply pipe 94. The water supply pipe 94 is disposed in a front portion of the inside of the main body 2, and extends in a vertical direction. An upper end of the water supply pipe 94 is connected to a sprinkler 96 installed on an upper side of the inlet 2*a*. The sprinkler 96 includes a sprinkling port 96*a* provided to spray water radially toward the inside of the drum 4.

Therefore, in response to that the circulation pump 91 is driven, the water stored in the tub 3 is delivered and then evenly sprayed from the upper side of the opening 44 of the drum 4 to the bottom of the drum 4, that is laundry accommodated in the drum 4. Therefore, the sprayed water efficiently wets the laundry. Some amount of water is supplied into the laundry and excess water is drained. In response to driving of the circulation pump 91, water is circulated inside the tub 3 and the amount of water is maintained.

An outlet of the drain pump 92 is connected to the drain pipe 95. The drain pipe 95 is disposed in the lower portion of the main body 2, and extends in a front-rear direction. A rear end of the drain pipe 95 is exposed to the outside from the rear surface of the main body 2. Therefore, in response to driving of the drain pump 92, water inside the tub 3 is discharged from the washing machine 1A, and an amount of water is reduced.

In the washing machine 1A, because a small amount of water is used in the washing cycle, the circulation pump 91 and the drain pump 92 may have low power. Therefore, it is possible to use a small-sized pump that is cheaper than the conventional pump.

<Operation of Drum Type Washing Machine>

Figure 6:
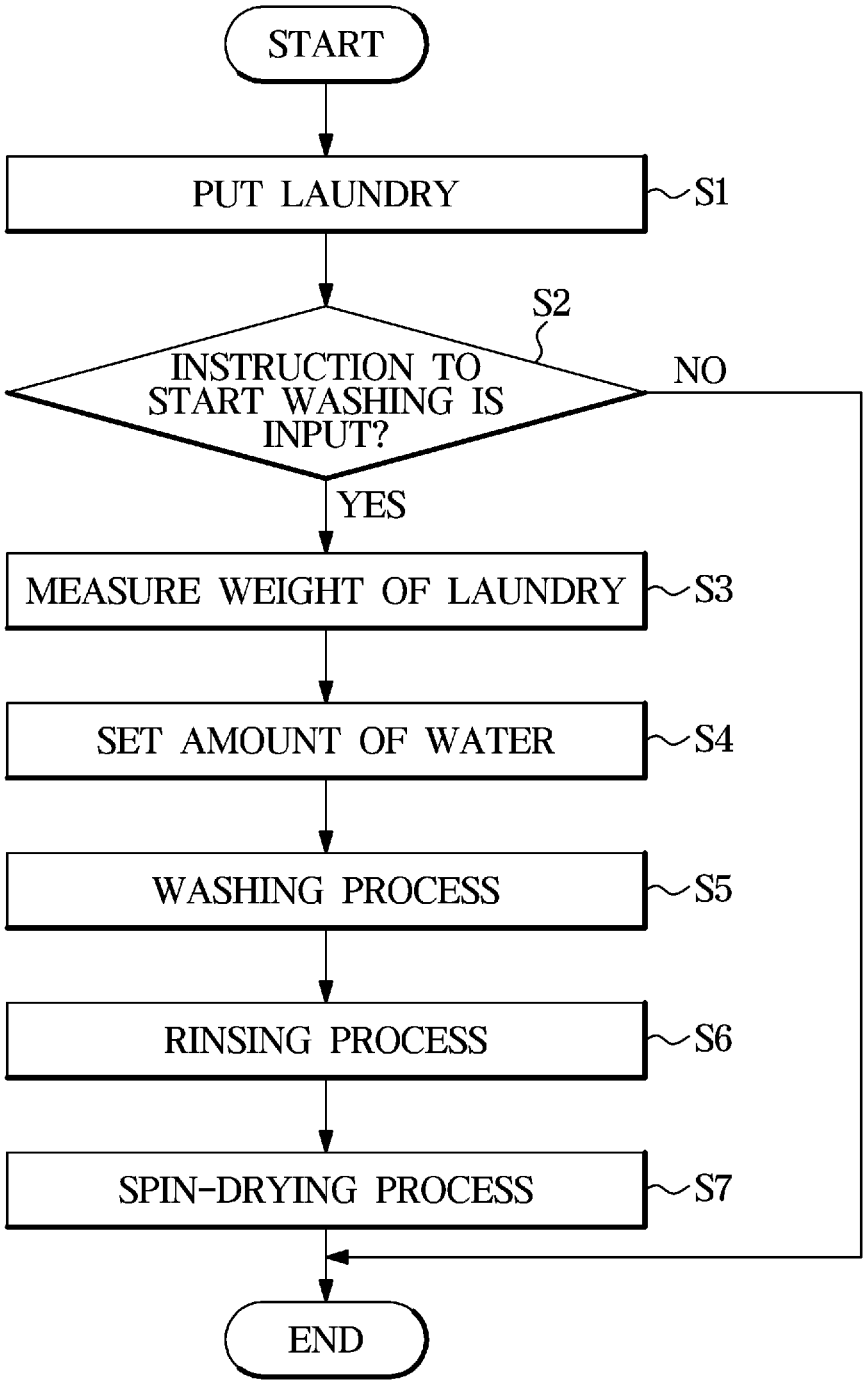
FIG. 6 is a flowchart illustrating a main flow of an operation of the drum type washing machine.

FIG. 6 illustrates an example of an operation of the washing machine 1A according to one embodiment.

In response to performance of the washing operation, a user first puts laundry into the drum 4 (1). In the case of the washing machine 1A, a user puts into a detergent into the detergent dispenser 8*c*. Through manipulation of the manipulator 7, an instruction to start washing is input to the controller 6 (yes in 2). The controller 6 (the washing controller 61) automatically starts a series of operations including the washing, rinsing, and spin-drying cycles according to the instruction.

Prior to the washing cycle, the controller 6 (the laundry weight measurement portion 62) performs the laundry weight measurement process by rotating the drum 4, into which the laundry is put, in order to set an amount of supply water (3). That is, the controller 6 measures the weight of the laundry in a non-wet state.

The controller 6 accelerates and decelerates the drum 4 based on a predetermined condition, and calculates the weight of the laundry from a change in torque acting on the drum 4 by calculation. After the weight of the laundry is calculated, the controller 6 sets the amount of supply water based on the calculated weight of the laundry (4).

Particularly, water supply information for setting an appropriate amount of supply water corresponding to the weight of laundry is set in the information memory 63. In the washing machine 1A, minimum amount of water that allows all of laundry to be wet in accordance with the weight of laundry, that is an amount of water absorbable by the laundry is set as the water supply information. The controller 6 compares the calculated weight of the laundry with the water supply information so as to specify an amount of water absorbable by the laundry.

In the information memory 63, the amount of water that the circulation pump is able to deliver may be set as the water supply information. That is, in order that the circulation pump 91 is able to deliver, at least amount of water that satisfies the circulation pump 91 and the water supply pipe 94, and at least amount of water that allows the circulation pump 91 to be dynamically stabilized and to allow the sparkling port 96*a* to appropriately spray water are needed. Accordingly, in the information memory 63, the minimum amount of water that is sprayed in a stable and appropriate state by the delivering of the circulation pump 91 is set as the water supply information.

The controller 6 sets an appropriate water supply amount based on the water supply information. For example, in response to that a sum of an amount of water absorbable by laundry and an amount of water that is stably and appropriately sprayed (the maximum amount of water absorbable by laundry+the minimum amount of water that the circulation pump 91 is able to deliver) is set as the water supply amount, a total amount of water used for the washing may be reduced to the extreme. In general, it is appropriate to spray water for a certain amount of time, and thus a certain amount of water is further added.

The heater 31 is disposed in the water reservoir 30 in such a way that the heater 31 is surely immersed in water for using hot water in the washing cycle. For example, the heater 31 is disposed at a position lower than the water level in a state in which water that the circulation pump 91 is able to deliver is stored in the water reservoir 30.

Figure 7:
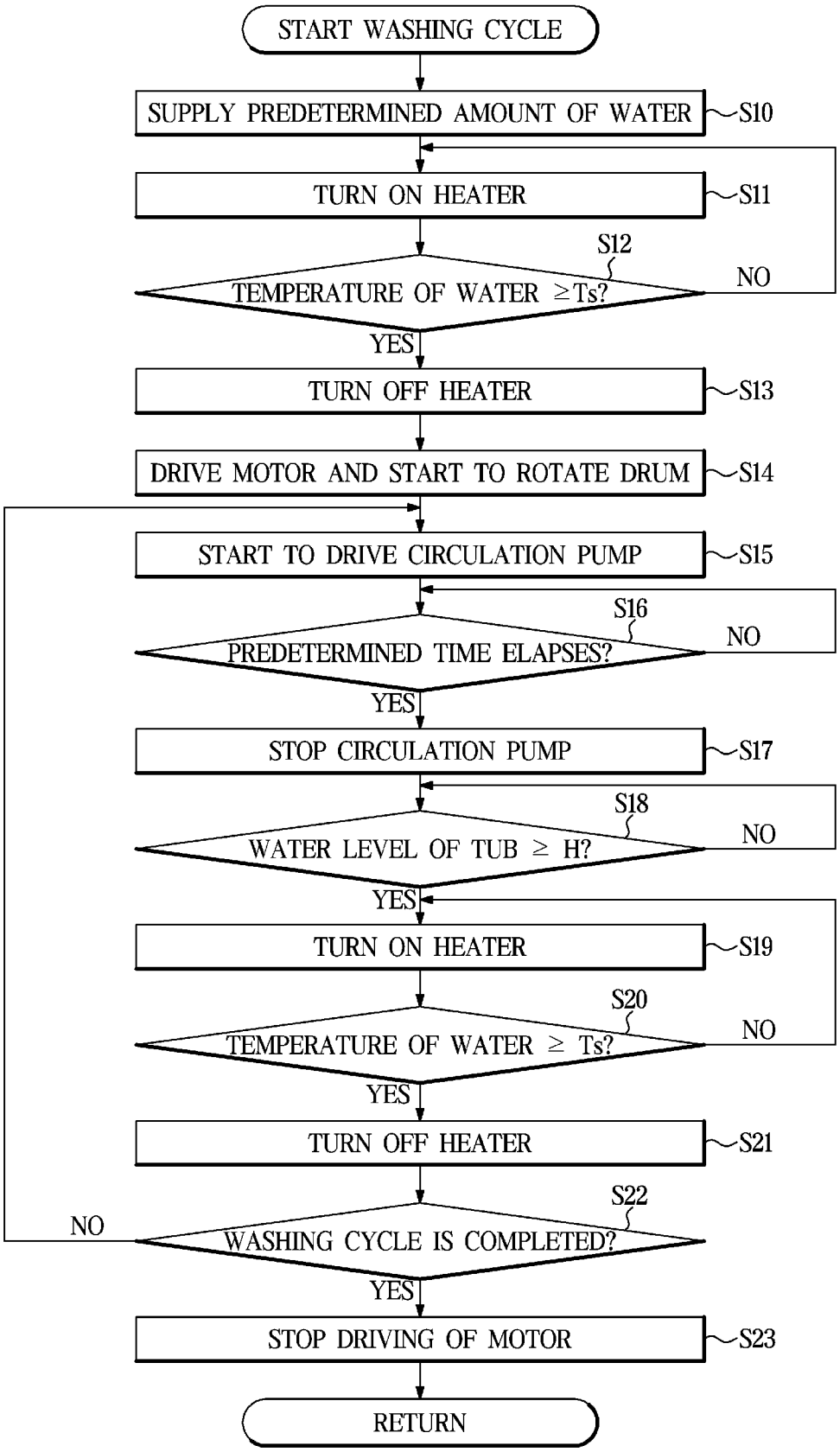
FIG. 7 is a flowchart illustrating a main flow of a washing cycle.

In response to the completion of the setting of the water supply amount, the controller 6 starts the washing cycle (5). FIG. 7 illustrates a flow of process in the washing cycle.

Figure 8A:
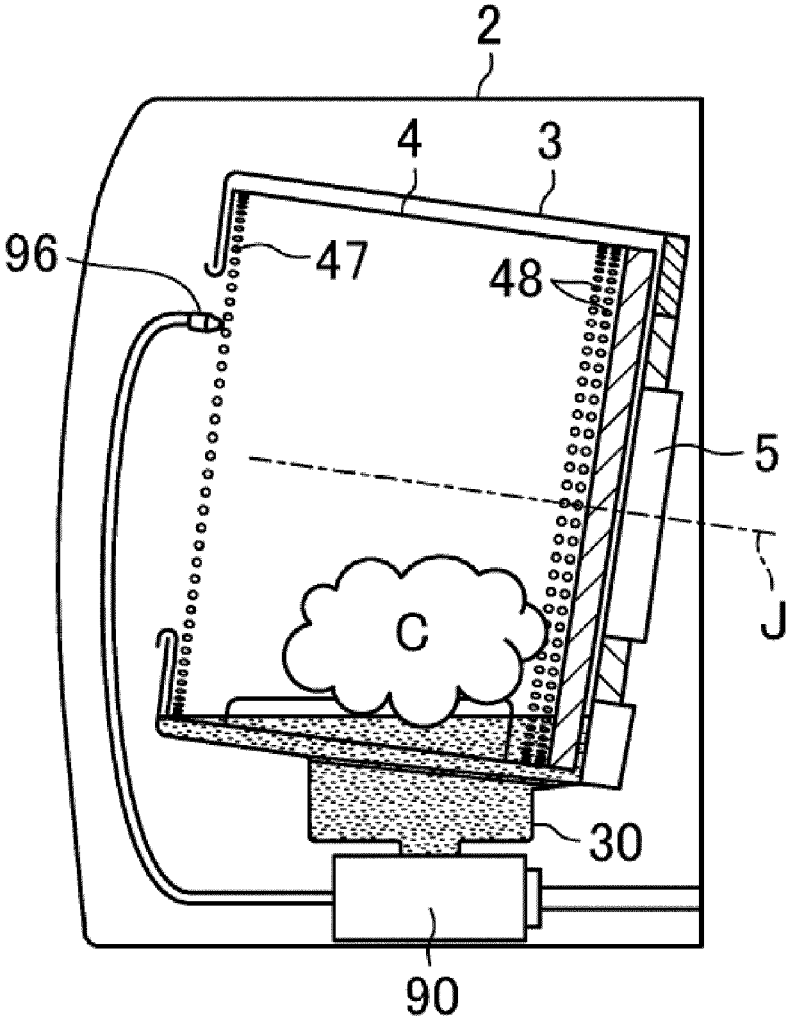
FIG. 8A is a schematic view illustrating a main process in the washing cycle.

In response to the start of the washing cycle, the controller 6 controls the water supply valve 8*b* to supply a set amount of water to the tub 3 (10). In this case, the detergent contained in the detergent dispenser 8*c* is put into the tub 3 together with water to be supplied. As a result, as illustrated in FIG. 8A, a predetermined amount of wash water (a mixture of water and detergent) is stored in the lower portion of the tub 3. The water reservoir 30 is in a state of being filled with water (clothes corresponding to laundry is indicated by a letter "C").

In response to that the controller 6 determines that the water reservoir 30 is filled with water based on the detected value input from the water level sensor 11, the controller 6 operates the heater 31 to heat the wash water (11). In the information memory 63, a predetermined reference temperature Ts (for example, 60° C.) having a high washing effect is set in advance.

The controller 6 determines whether or not the water temperature reaches the reference temperature Ts based on the detected value input from the water temperature sensor 12 (12). Accordingly, in response to that the water temperature is determined to be equal to or higher than the reference temperature Ts, the controller 6 stops the operation of the heater 31 (13). Because the total amount of water is small, it is possible to heat up to the reference temperature Ts in a short time.

The controller 6 drives the drive device 5 (motor 51) to start rotation of the drum 4 (14). The controller 6 rotates the drum 4 at a predetermined rotational speed based on the detected value input from the motor sensor 13.

Figure 8B:
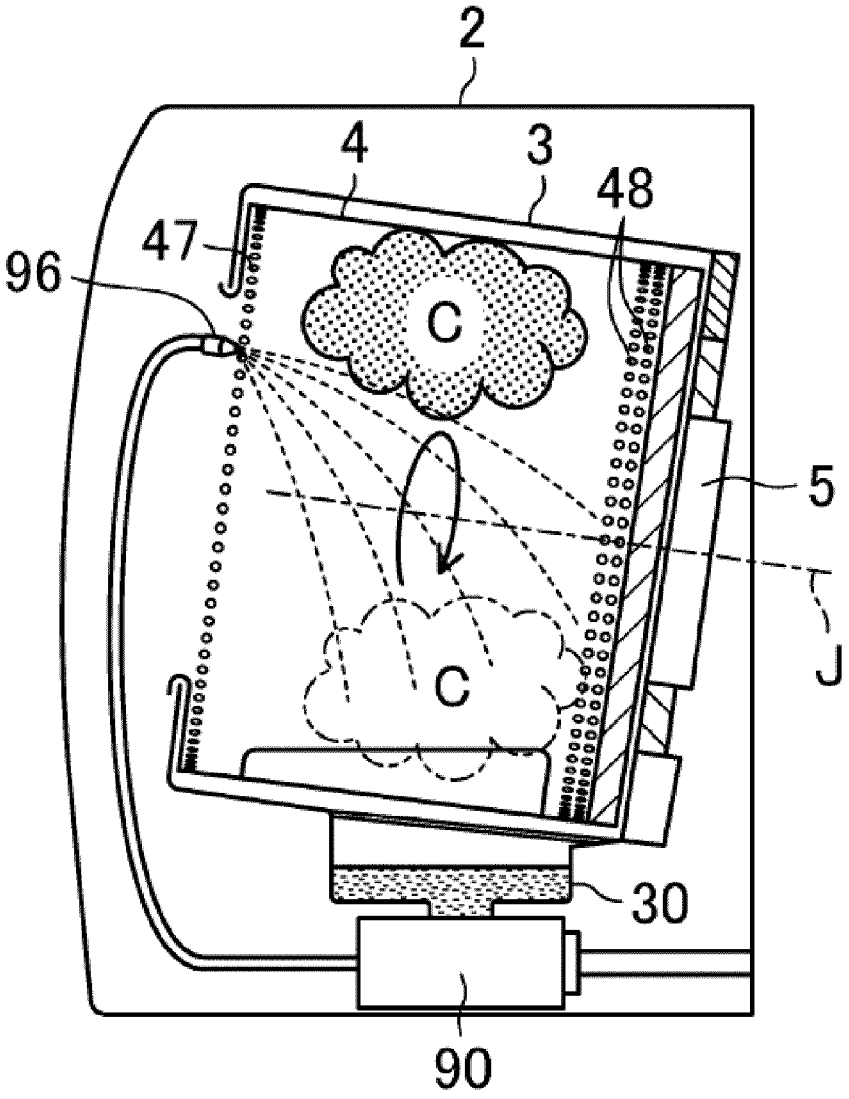
FIG. 8B is a schematic view illustrating the main process in the washing cycle.

The controller 6 starts to drive the circulation pump 91 (15). Accordingly, as shown in FIG. 8B, a water spray process, in which wash water is sprayed to the inside of the drum 4 while the drum 4 is rotated, is performed.

It is appropriate to first start to drive the circulation pump 91 before rotating the drum 4, and to start rotation after wetting the clothes C by the water spray process. Therefore, it is possible to more effectively perform the washing cycle. However, this may not be the case when using hot water.

The clothes C is wetted with heated wash water by the water spray process. Because an amount of water, which is absorbable by the clothes C, is sprayed, the clothes C becomes in a wet state with the amount of water, which is absorbable, within a relatively short time. That is, because the weight of the clothes C is about an upper limit, a strong impact force may be obtained, and thus a high washing effect may be obtained.

For spraying water, a certain spray pressure is required and it is also required to spray with a certain amount of water. Further, because the wash water maintained in the tub 3 is a small amount, the wash water stored in the tub 3 may disappear in a short time, and water may not be delivered to the circulation pump 91.

In the information memory 63, a predetermined time, which is needed to become an amount of water that the circulation pump 91 is unable to deliver since the water reservoir 30 is full (reference water level), is set in advance. The controller 6 determines whether or not the predetermined time elapses since the water reservoir 30 is full, based on the detected value input from the water level sensor 11 (16).

Figure 8C:
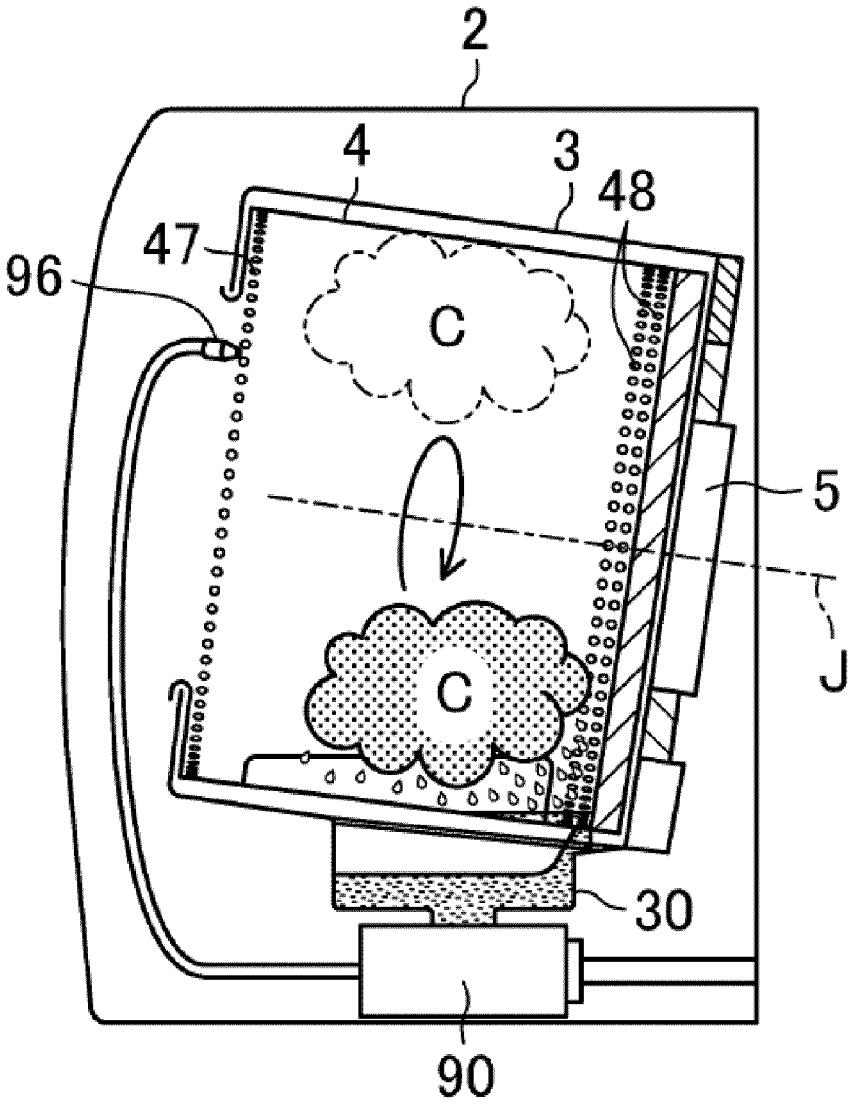
FIG. 8C is a schematic view illustrating the main process in the washing cycle.

In response to the predetermined time elapsing since the water reservoir 30 is full, the controller 6 stops driving the circulation pump 91 (17). As illustrated in FIG. 8C, although spraying water is not performed, the clothes C is sufficiently wet, and the drum 4 is rotated, thereby continuing the beating-washing.

At this time, because there is little wash water inside the drum 4, the clothes C falls from the upper surface to the lower surface of the drum 4 and collides against the wall surface of the drum 4. Therefore, it is possible to increase the washing effect because the clothes C receives a strong impact force.

Because there is almost no extra wash water inside the drum 4 and no wash water is stored between the drum 4 and the tub 3, excess energy consumption may be suppressed and power consumption may be reduced.

Although the wash water escapes from the laundry due to an impact because the clothes C is thrown on the lower surface of the drum 4, the wash water may be absorbed by the laundry, again because there are few through holes in the circumferential wall 41 of the drum 4. The wash water may not rapidly escape from the clothes C due to the impact. Therefore, even when the wash water is not sprayed, the wash water suitable for the clothes C may be maintained for a long time. As a result, it is possible to stably and efficiently perform the beating-washing.

By repeating of the beating-washing, the wash water gradually escapes from the clothes C. The plurality of protrusions 46 provided to receive the clothes C is formed on the circumferential wall 41 of the drum 4. A space (water flow path) provided to communicate with the rear through hole 48 is provided under the clothes C. Therefore, wash water slowly flowing out of the clothes C is smoothly and efficiently guided to the rear through hole 48 through the water flow path.

The wash water flowing out of the clothes C is dropped into the tub 3 through the rear through hole 48. The wash water dropped in the tub 3 is collected and filled in the water reservoir 30. The controller 6 waits without performing the water spray process until the wash water is stored in the tub 3 and the circulation pump 91 is able to deliver water (waiting process).

The controller 6 determines whether the water level of the tub 3 reaches a predetermined water level h, that is, whether or not the reservoir 30 is full, based on the detected value input from the water level sensor 11 (18). In response to that the water reservoir 30 is determined to be full (reference water level), the controller 6 operates the heater 31 (19).

The controller 6 determines whether or not the water temperature reaches the reference temperature Ts (20). In response to that the water temperature is determined to be equal to or higher than the reference temperature Ts, the controller 6 stops the operation of the heater 31 (21). Because the wash water is already heated to the reference temperature Ts and is a small amount, it is possible to heat the water to the reference temperature Ts in a short time.

The controller 6 determines whether or not the washing cycle is completed, and in response to that the washing cycle is not completed (no in 22), the controller 6 performs the water spray process, again (15). As mentioned above, the controller 6 intermittently repeats the waiting process until the washing cycle is completed (15 to 21).

In response to the completion of the washing cycle, the controller 6 stops driving of the drive device 5 (motor 51) (23), and returns to the main control shown in FIG. 6.

The controller 6 performs the rinsing cycle (6). In the rinsing cycle, first, the controller 6 drives the drain pump 92 and drains the wash water stored in the tub 3. Because there is a small amount of wash water, it is possible to drain the wash water in a short time.

The controller 6 performs water supply and agitation process, similar to the washing cycle. An amount of supply water may be the same as the washing cycle, or increased from the washing cycle. Although it is appropriate to also perform heating by the heater 31, it may not be required to perform the heating. The rinsing cycle may be performed several times. A content of the rinsing cycle may be appropriately set according to the specifications.

In response to the completion of the rinsing cycle, the controller 6 performs the spin-drying cycle (7). In the spin-drying cycle, the drum 4 is rotated at high speed for a predetermined period of time. The clothes C is attached to the inner surface of the circumferential wall 41 of the drum 4 by centrifugal force. The water contained in the clothes C flows out of the drum 4 through the front through hole 47 and the rear through hole 48. Accordingly, the clothes C is spin-dried.

In response to that the amount of water is small even in the rinsing cycle (the last in the case of multiple times), the spin-drying may be performed in a short time although the number of the through holes is small.

Water stored in the tub 3 is discharged by the spin-drying as the controller 6 drives the drain pump 92. In response to the completion of the spin-drying, the completion of the washing operation is notified, such as ringing a busser, and the operation of the washing machine 1A is completed.

As described above, by the washing machine 1A to which the technology according to the embodiment is applied, not only a very high level of water saving may be realized, but also a high washing effect may be obtained.

(Modified example of drum 4)

Figure 9:
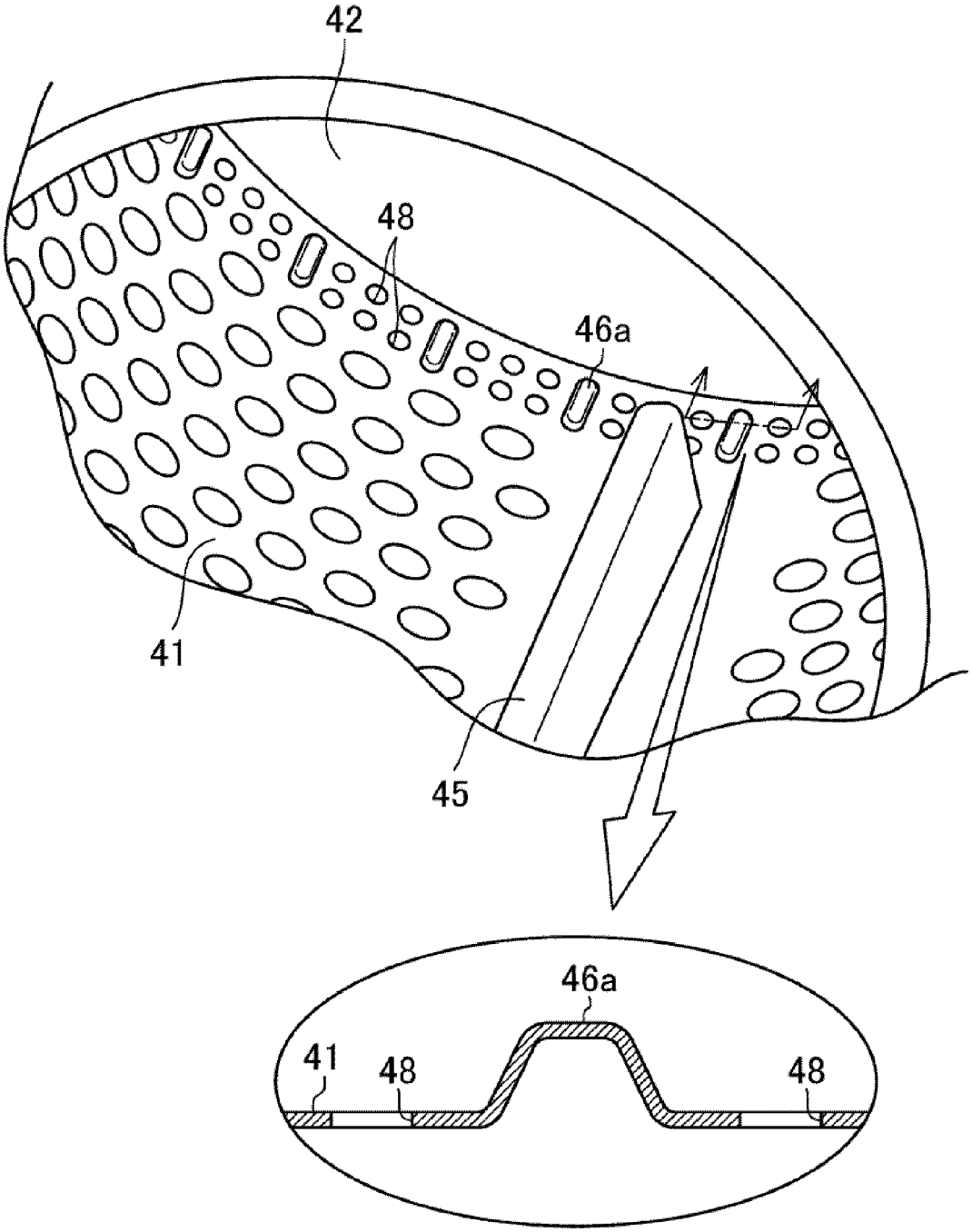
FIG. 9 is a schematic view illustrating a concave portion of a modified example of the drum according to the first embodiment of the present disclosure.

As shown in FIG. 9, a plurality of rib protrusions 46*a* protruding inward over the entire circumference may be provided in a portion, which is near the bottom, of the circumferential wall 41 of the drum 4. The rib protrusions 46*a* are disposed along the circumferential direction with a predetermined distance from each other, and two rows of the rear through holes 48 are disposed between the adjacent rib protrusions 46*a*.

Accordingly, even when laundry is collected on the bottom of the drum 4, a space between the laundry and the circumferential wall 41 may be secured by the rib protrusion 46*a*. As a result, because the rear through hole 48 is less likely to be blocked, it is possible to stably maintain the smooth discharge of wash water from the drum 4.

Second Embodiment

There are almost no holes in the drum of the washing machine 1A (hole-less type). Therefore, in comparison with a conventional drum-type washing machine in which a number of through holes are formed, the hole-less type drum washing machine 1 has a difficulty in the spin-drying performance. Accordingly, in a second embodiment, a structure of a drum configured to improve spin-drying performance is provided.

A structure and operation effect of a washing machine 1B will be described in details. In the following description, for convenience, the same reference numerals are used for members, structures, controls, etc. having the same functions as the above-described washing machine 1A, and a description thereof will be omitted or simplified.

<Structure and Operation of Washing Machine 1B>

Figure 10:
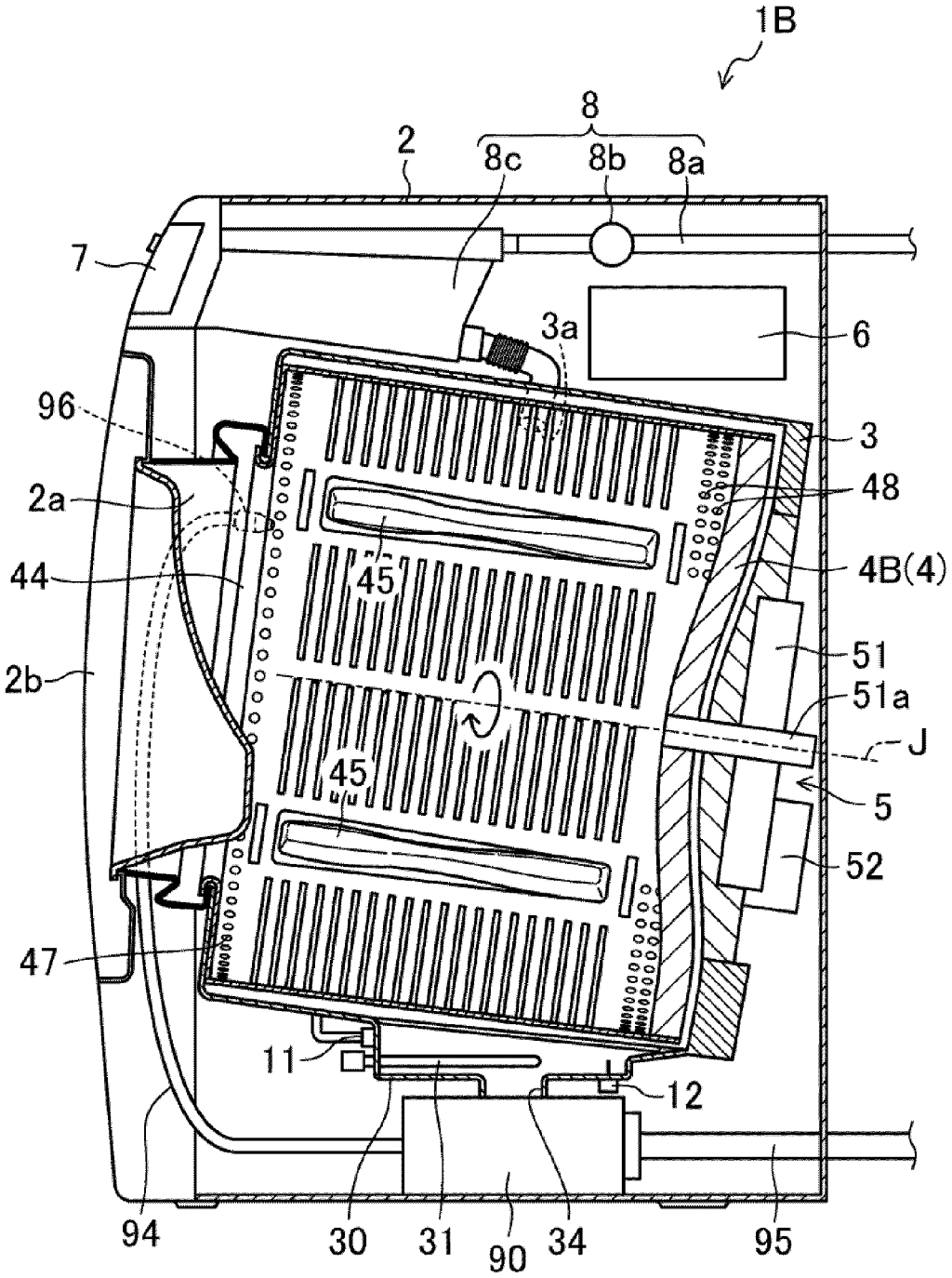
FIG. 10 is a schematic view illustrating a main structure of a drum type washing machine according to a second embodiment of the present disclosure.

FIG. 10 illustrates the washing machine 1B. Except for the drum 4, the basic structure of the washing machine 1B is the same as that of the washing machine 1A described above. That is, the washing machine 1B may include the main body 2, the tub 3, the drum 4, the drive device 5, the controller 6 (refer to FIG. 4), the manipulator 7, the water supplier 8, and the water treatment unit 90.

The operation of the washing machine 1B is also the same as that of the washing machine 1A described above (refer to FIGS. 6, 7, 8A to 8C, and descriptions thereof). In the washing machine 1B, a structure of the drum 4 is configured to improve the spin-drying performance.

<Drum 4>

Figure 11A:
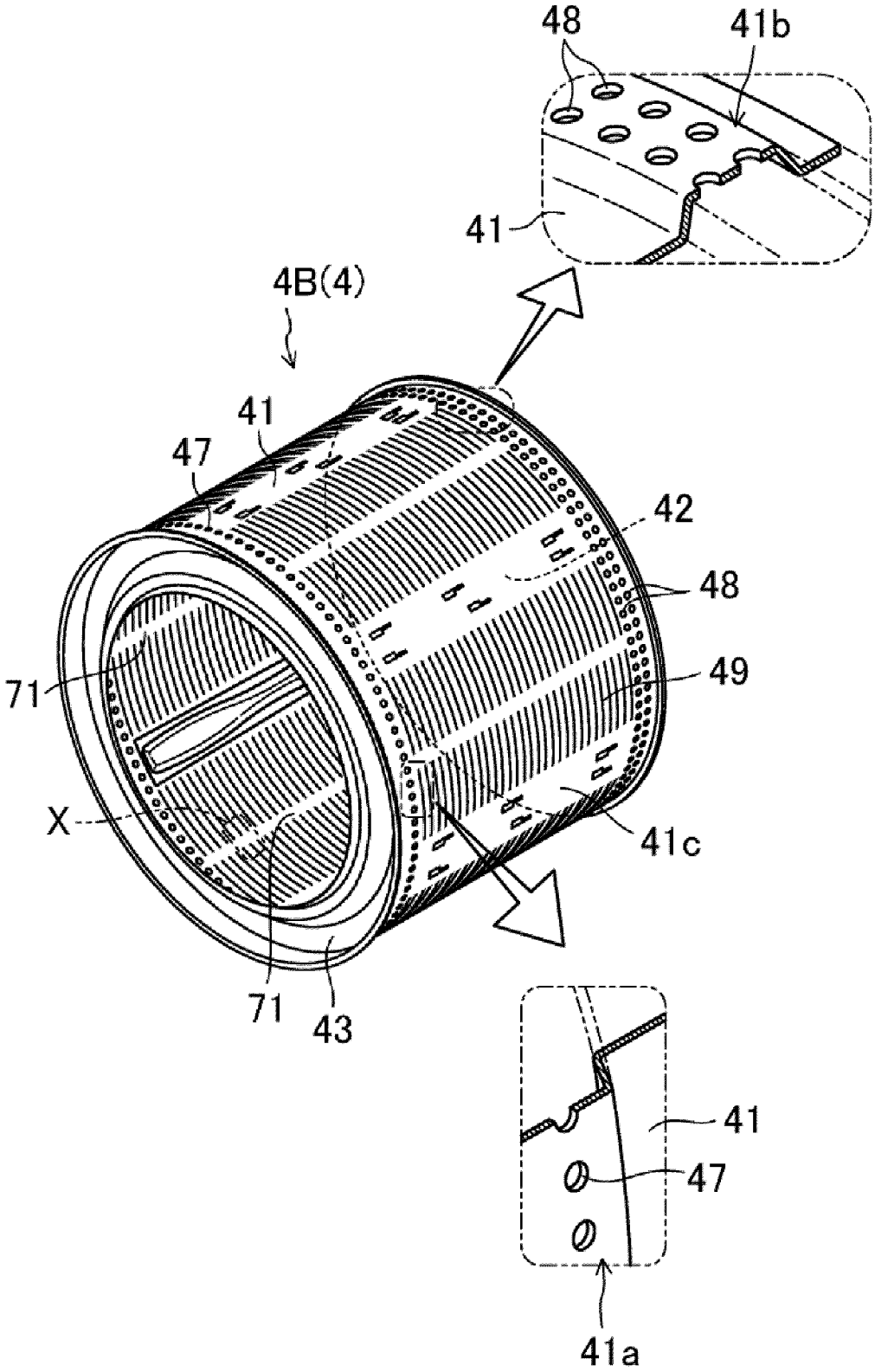
FIG. 11A is a schematic perspective view illustrating a drum according to the second embodiment of the present disclosure.

FIG. 11A illustrates the drum 4 (drum 4B) in the washing machine 1B according to the embodiment. The drum 4B also includes a cylindrical circumferential wall 41, a disk-shaped bottom wall 42 provided to cover the bottom, and a circular annular flange wall 43 provided to protrude inward from the edge of the opening side. The circumferential wall 41, the bottom wall 42, and the flange wall 43 are each formed in a predetermined shape by pressing a stainless-steel plate.

For example, as for the circumferential wall 41, a concave and convex shape or hole is formed by pressing a thin stainless-steel plate. The circumferential wall 41 is formed in such a way that the stainless-steel plate pressed by the bending process is rounded, and ends thereof are connected to each other. A plurality of front through holes 47, a plurality of rear through holes 48, and a plurality of protruding ribs 49 are formed in the circumferential wall 41. An inner surface of the circumferential wall 41, in which the pressing process is not performed and the concave and convex structure is not formed, may be referred to as a reference surface.

(Front Through Hole 47 and Rear Through Hole 48)

The front through hole 47 and the rear through hole 48 are holes respectively penetrating from the inner surface to the outer surface of the circumferential wall 41. The front through hole 47 is formed at a front end portion of the circumferential wall 41 and arranged to be aligned in a row in the circumferential direction over the entire circumference thereof. The rear through hole 48 is formed at a rear end portion of the circumferential wall 41 and arranged to be aligned in two rows in the circumferential direction over the entire circumference thereof.

The front through hole 47 is mainly used for drainage from the drum 4B in the spin-drying cycle, and the rear through hole 48 is used for drainage from the drum 4B in the spin-drying process in addition to drainage in the washing and rinsing cycles. Therefore, an opening ratio (ratio of the opening area per unit area) is larger in the rear portion than in the front portion of the drum 4B inclined to the rear side.

As shown enlarged in FIG. 11A, a concave groove portion (front concave groove portion 41*a*) extending in a band shape in the circumferential direction is formed in the front end portion of the circumferential wall 41 by the pressing process. The rear end of the circumferential wall 41 is also provided with a concave groove portion (rear concave groove portion 41*b*) extending in a band shape in the circumferential direction. The front concave groove portion 41*a* and the rear concave groove portion 41*b* are processed in such a way that the circumferential wall 41 protrudes outward, respectively, and an inner surface thereof are relatively recessed from the reference surface.

The front through hole 47 is formed in the front concave groove portion 41*a*, and the rear through hole 48 is formed in the rear concave groove portion 41*b*. Accordingly, because the vicinity of each of the front through holes 47 and each of the rear through holes 48 is recessed than the reference surface, the water flowing along the inner surface of the circumferential wall 41 easily flows through each of the front through holes 47 and each of the rear through holes 48. Therefore, good drainage properties may be obtained.

(Protruding Rib 49)

Figure 11B:
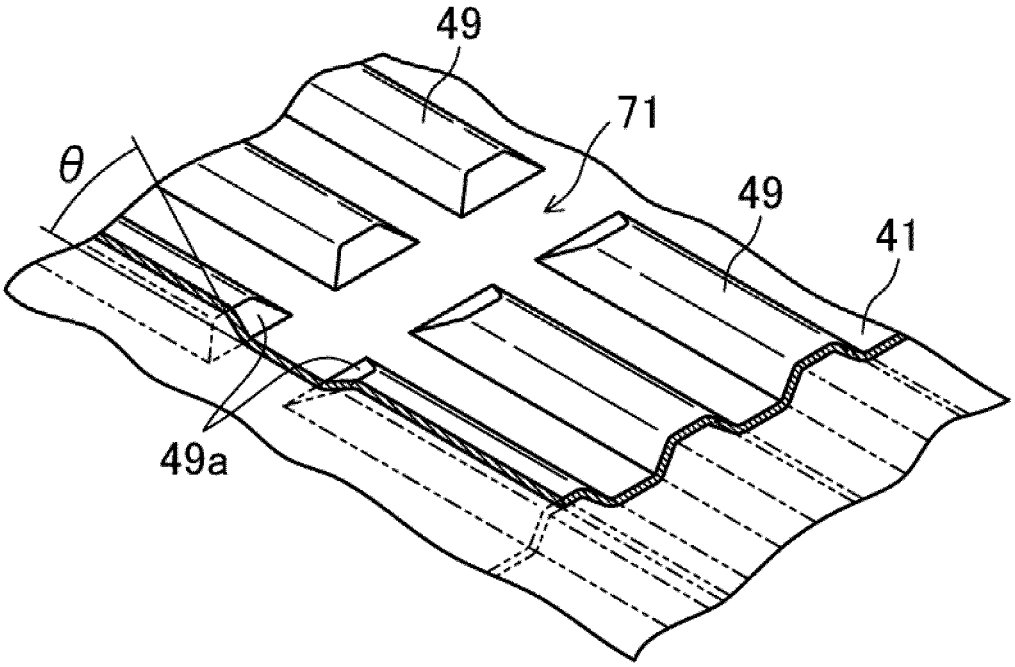
FIG. 11B is a schematic enlarged view illustrating a portion indicated by an arrow X of FIG. 11A.

As shown enlarged in FIG. 11B, each of the protruding ribs 49 is formed to protrude inward from the inner surface (reference surface) of the circumferential wall 41 by the pressing process. Each of the protruding ribs 49 includes a cross-section having a substantially trapezoidal or dome-shape, and the each of the protruding ribs 49 extends along the circumferential direction with the same height (height from the inner surface). Therefore, by the protruding rib 49, the drainage performance and spin-drying performance are improved and the rigidity of the drum 4B is structurally reinforced.

The protruding rib 49 is formed in a range, excluding a region (lifter installation portion 41*c*) in which each lifter 45 is installed, and the front end portion (the front concave groove portion 41*a*) in which the front through hole 47 is formed, and the rear end portion (the rear concave groove portion 41*b*) in which the rear through hole 48 is formed, among portions of the circumferential wall 41.

Each of the protruding ribs 49 is divided at a plurality of locations. Accordingly, a water flow path for allowing water to flow along the inner surface of the circumferential wall 41 is formed between the front through hole 47 and the rear through hole 48. In the embodiment, each of the protruding ribs 49 is divided by the same width at the same position in the circumferential direction, and a plurality of water flow paths (connection flow path 71) extending in a straight line approximately perpendicular to the protruding rib 49 is formed from the front end portion to the rear end portion of the drum 4B.

An end surface (inclined end surface 49*a*) of the protruding rib 49 facing the connection flow path 71 is inclined at a predetermined angle with respect to a bottom surface of the connection flow path 71, that is the inner surface (reference surface) of the circumferential wall 41 (less than 90°). Each inclined end surface 49*a* of the protruding rib 49 (inclined end faces 49*a* and 49*a* facing in the circumferential direction with the connection flow path 71 interposed therebetween) is formed at the side of the protruding end of the protruding rib 49 to be inclined downward toward the bottom surface of the connection flow path 71.

Similarly, each side surface of the protruding ribs 49 (side surface extending in the circumferential direction) is also inclined downward, and the side surface also has the same inclination angle θ with respect to the reference surface between the two protruding ribs 49 adjacent in the axial direction (inclined side surface). The inclination angle θ of each inclined end surface 49*a* and each inclined side surface is appropriately 20° or more, and more appropriately 40° or more.

By inclining the inclined end surface 49*a* of each of the protruding ribs 49 at such an angle, it is possible to secure the water flow path even when the laundry is pressed against the circumferential wall 41 by centrifugal force during the spin-drying. In addition, it is possible to well squeeze the laundry by increasing the contact angle, and thus an excellent spin-drying effect may be obtained even with a hole-less type drum.

(Lifter 45)

On the inner surface of the circumferential wall 41, a plurality of lifters 45 is provided to extend along the axial direction and installed at regular intervals.

Figure 12A:
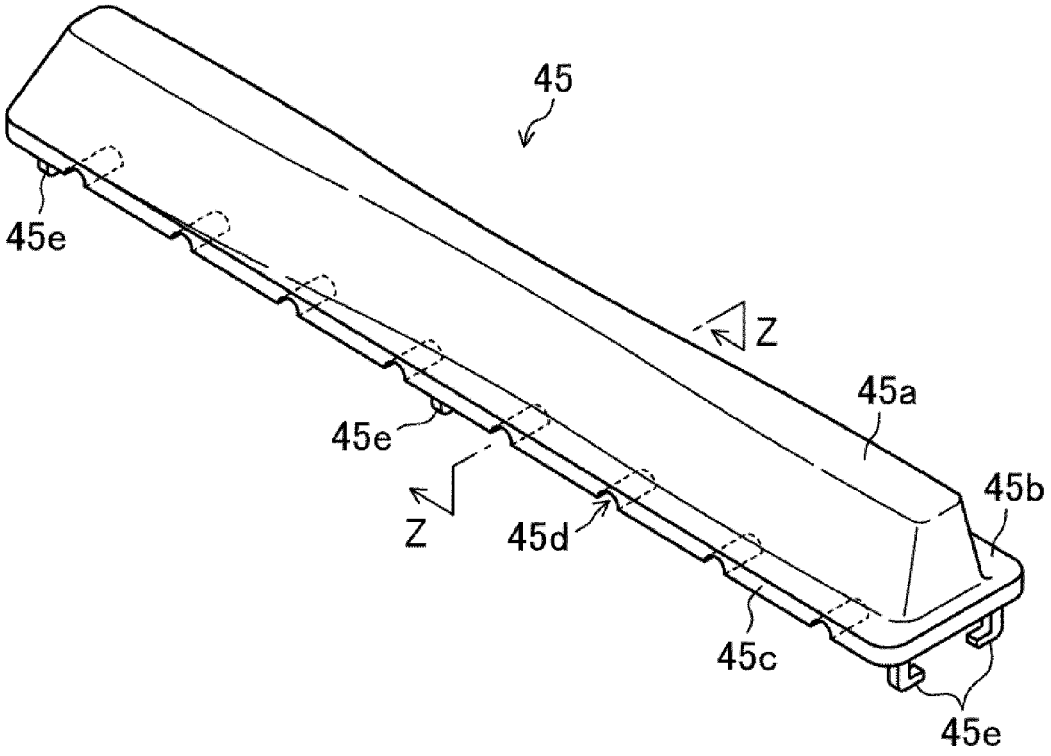
FIG. 12A is a schematic perspective view illustrating a lifter.
Figure 12B:
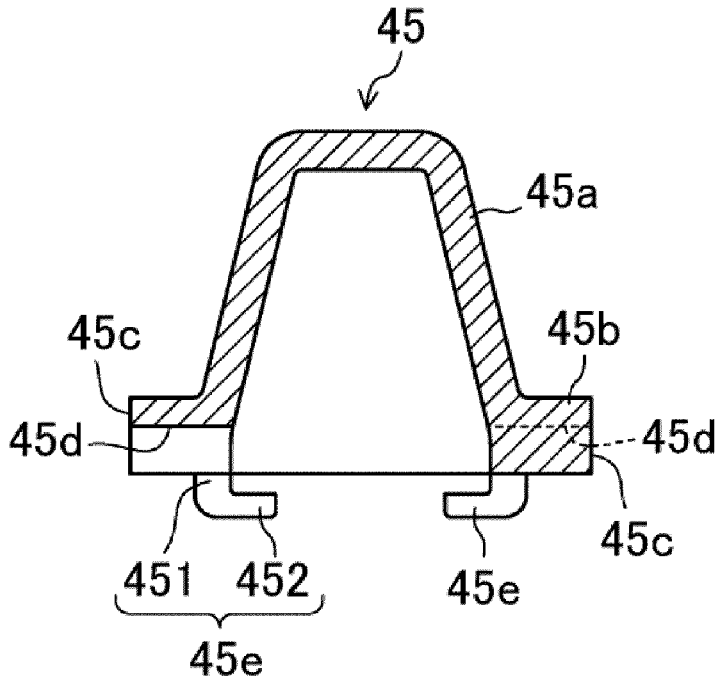
FIG. 12B is a schematic cross-sectional view taken along an arrow line Z-Z of FIG. 12A.

FIGS. 12A and 12B illustrate the lifter 45. The lifter 45 is provided with a plastic injection molded product, and formed in a hollow cylindrical shape with an open bottom surface. Particularly, the lifter 45 includes an elongated body portion 45A having an inverted U-shaped cross section, and a flange portion 45B protruding outward from a lower edge of the body portion 45A.

The body portion 45A includes a shape in which a middle portion thereof is constricted, and a side surface thereof is formed in a smooth curved surface. The flange portion 45B is formed in a substantially rectangular frame shape. The flange portion 45B has a thickness to position the body portion 45A at a predetermined height from the inner surface (reference surface) of the circumferential wall 41.

Figure 13:
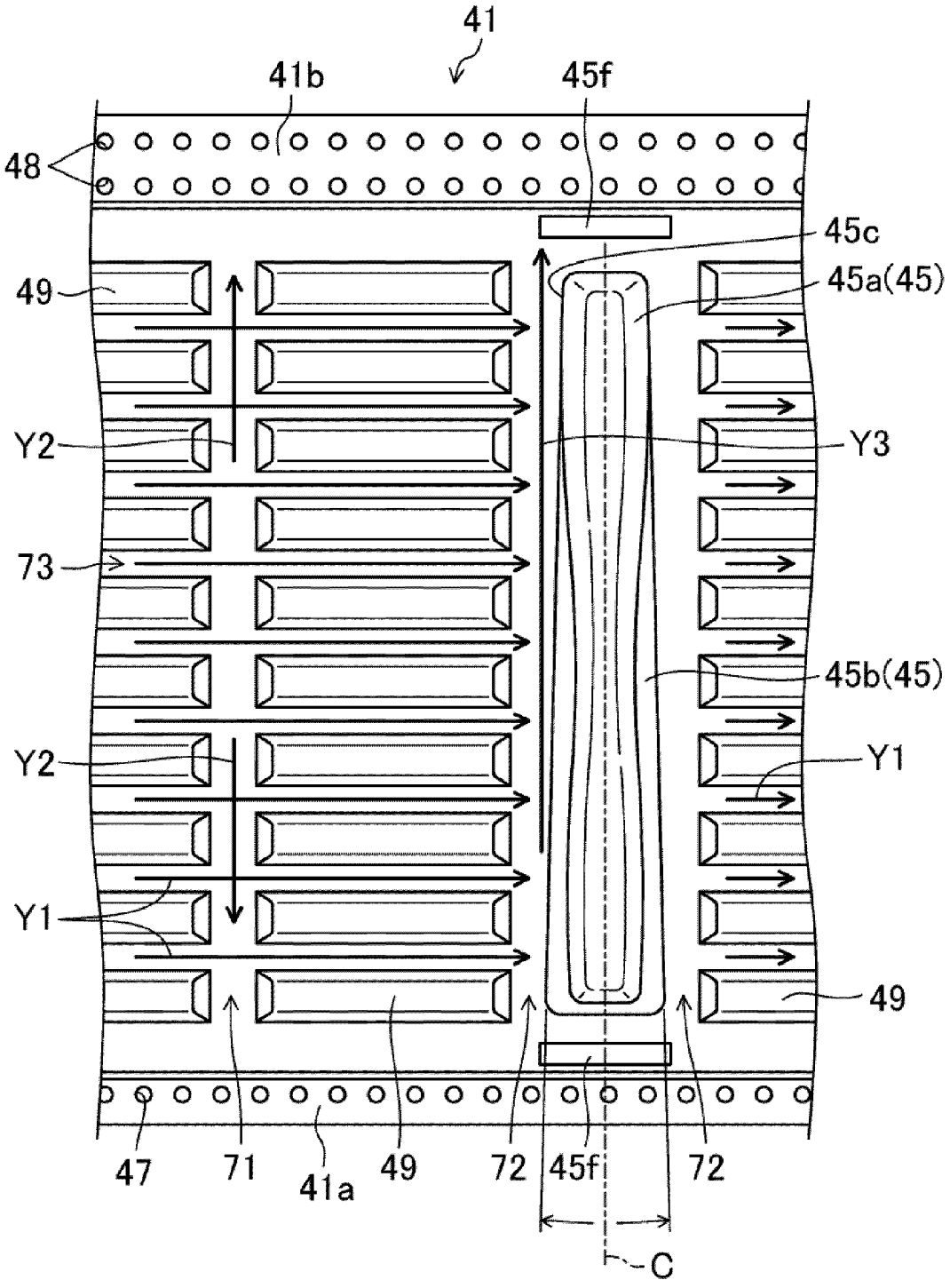
FIG. 13 is a schematic diagram illustrating a structure of a circumferential wall inner surface of the drum.

As illustrated in FIG. 13, a pair of side edges of the flange portion 45B is inclined with respect to a center line C of the lifter 45 to allow a distance from one end thereof to the other end thereof to be gradually increased. FIG. 13 illustrates that a distance in a front portion is greater than a distance in a rear portion.

An end surface (water guide surface 45*c*), which is substantially perpendicular to the inner surface of the circumferential wall 41 in a state in which the lifter 45 is mounted to the circumferential wall 41, is formed at the side edges of the flange portion 45B. A through hole (water through hole 45*d*) provided to allow an inside of the lifter 45 to communicate with an outside of the lifter 45 is formed at a plurality of locations of the water guide surface 45*c*.

A plurality of mounting hooks 45*e* is provided in a symmetrical shape on a lower surface of the flange portion 45B. That is, each mounting hook 45*e* has an approximately L-shape, and the mounting hook 45*e* includes a base portion 451 extending downward from the lower surface of the flange portion 45B, and a locking portion 452 extending laterally from a protruding end of the base portion 451. A pair of mounting hooks 45*e* and 45*e* is disposed to face each other on the lower surface of each side edge of the flange portion 45B in a state in which the locking portions 452 face each other.

Figure 14:
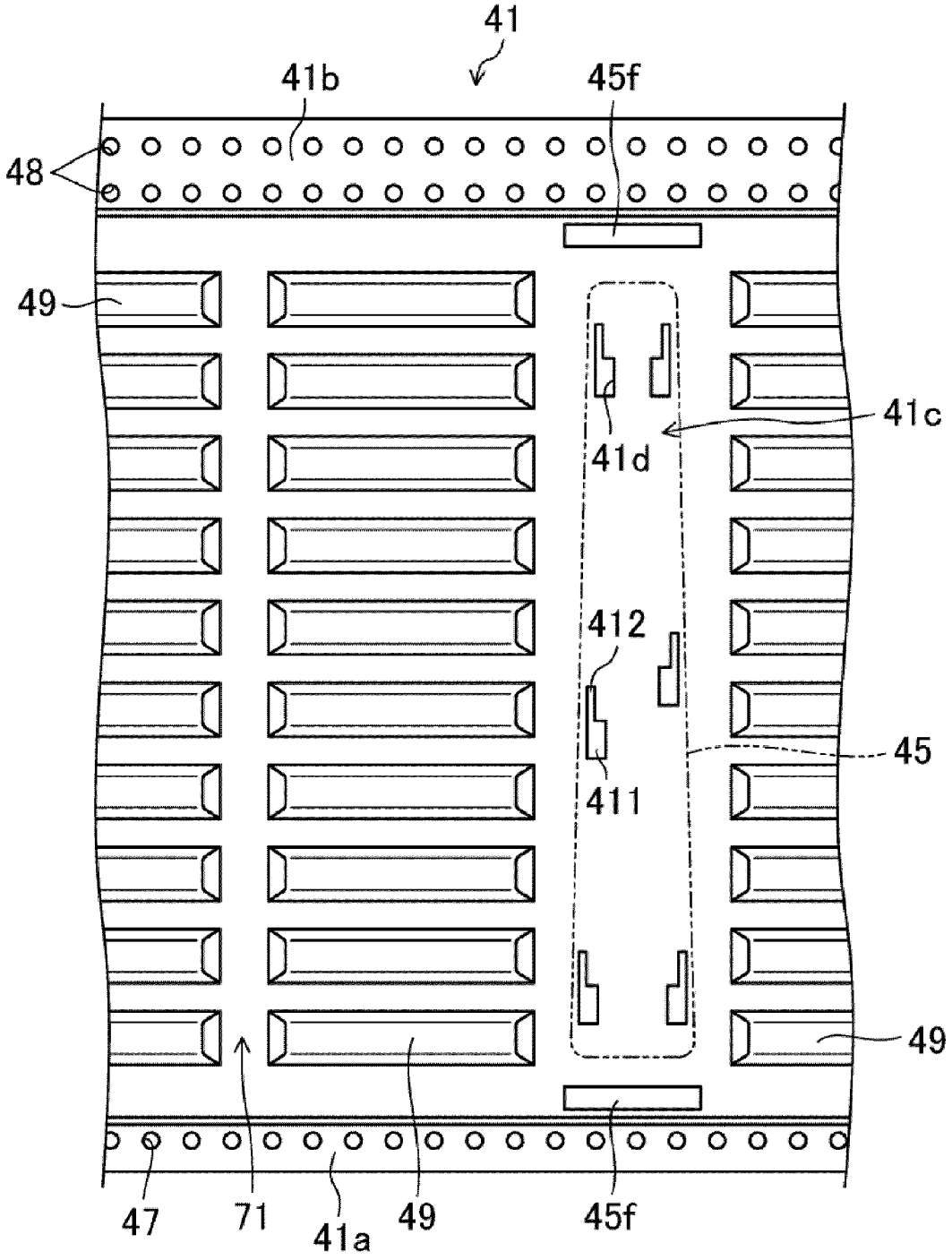
FIG. 14 is a view illustrating a state in which the lifter is removed from FIG. 13.

As shown in FIG. 14, in each of the lifter installation portions 41*c* of the circumferential wall 41, a plurality of mounting holes 41*d* is formed at positions corresponding to the mounting hooks 45*e*. Each mounting hole 41*d* includes an insertion portion 411 having a size in which the base portion 451 and the locking portion 452 are insertable, and a coupling portion 412 having a size in which only the base portion 451 is insertable. The coupling portions 412 are formed to line up in an axial direction of the insertion portion 411.

Each lifter 45 is mounted to each lifter installation portion 41*c* in an operation to be described later.

Each mounting hook 45*e* is inserted into each insertion portion 411. Each of the locking portions 452 protrudes to the outside of the circumferential wall 41, and the lower surface of the flange portion 45B is in contact with the inner surface of the circumferential wall 41. The lifter 45 is slid in the axial direction, and each base portion 451 is fitted into the coupling portion 412. Accordingly, the lifter 45 is mounted at a predetermined position on the inner surface of the circumferential wall 41.

As shown in FIG. 13, as the lifter 45 is mounted to the circumferential wall 41, a water flow path (main flow path 72) axially extending between groups of adjacent protruding ribs 49 is formed on both side in the circumferential direction of the lifter 45. The water guide surface 45*c* of the flange portion 45B facing the main flow path 72 is inclined with respect to the axial direction, and thus the water guide surface 45*c* guides water to any one side of the front through hole 47 and the rear through hole 48 in response to the rotation of the drum 4*b*.

In response to mounting the lifter 45 to the circumferential wall 41, each insertion portion 411 is open, and the inside of the lifter 45 communicates with the outside of the drum 4B through each insertion portion 411. In addition, the inside of the lifter 45 is also in communication with the inside of the drum 4B through the water through hole 45*d* formed in the water guide surface 45*c*.

(Reinforcing Protrusion 45*f*)

It is appropriate to form a reinforcing protrusion 45*f* in a portion between the front end portion of the lifter 45 and the front through hole 47 and in a portion between the rear portion of the lifter 45 and the rear through hole 48 in the circumferential wall 41 (the embodiment illustrates an example of formation). Each reinforcing protrusion 45*f* is provided with an elongated protrusion protruding inward from the inner surface of the circumferential wall 41, and extends in the circumferential direction. Each of the reinforcing protrusions 45*f* is formed to have a length substantially equal to a width of the lifter 45 and faces the end portion of the lifter 45.

The plurality of protruding ribs 49 is formed on the circumferential wall 41, but the protruding rib 49 is not formed in the lifter installation portion 41*c* and the front and rear of the lifter installation portion 41*c*. Accordingly, a difference in the strength occurs in the circumferential direction of the circumferential wall 41. Accordingly, there is a difficulty that deformation easily occurs during bending, and it is difficult to obtain roundness. In addition, there is a difficulty that stress concentration occurs during use, and thus the drum 4B is easily deformed.

By providing the reinforcing protrusions 45*f* as described above, the difference in the strength in the circumferential direction of the circumferential wall 41 may be reduced, thereby solving this difficulty.

(Drainage in the Spin-Drying Cycle)

In the spin-drying cycle, the drum 4B gradually accelerates and reaches a predetermined high-speed rotation, and then the drum 4B is rotated at the predetermined high-speed for a predetermined period of time. The clothes C is pressed against the inner surface of the circumferential wall 41 of the drum 4B by centrifugal force. Because the protruding rib 49 is formed on the inner surface of the circumferential wall 41 and the strength of the circumferential wall 41 is reinforced, it is possible to stably maintain the high-speed rotation. Because the laundry is supported by the protruding ends of the protruding ribs 49, an annular (ring)-shaped flow path (annular flow path 73) between the protruding ribs 49 adjacent in the axial direction is formed.

Water, which flows to the outside by the centrifugal force, may freely move in the circumferential direction along the inner surface of the circumferential wall 41 by the annular flow path 73, as shown by an arrow Y1 in FIG. 13.

Further, in the axial direction, the plurality of connection flow paths 71 is formed from the front end portion to the rear end portion of the drum 4B. Therefore, even in a state in which laundry is pressed against the circumferential wall 41, water freely flows along the inner surface of the circumferential wall 41 through the connection flow path 71, as indicated by an arrow Y2 in FIG. 13.

In addition, the main flow path 72 extending in the axial direction is formed on both sides of the lifter 45. Because the laundry is supported by the protruding end of the lifter 45, a relatively large space is formed above the main flow path 72 even when the laundry is stuck to the circumferential wall 41. Therefore, the main flow path 72 may allow a large amount of water to smoothly flow in the axial direction.

Because the water guide surface 45*c* faces the main flow path 72, water may be guided in a predetermined direction (rear side in this embodiment) in the axial direction, as indicated by an arrow Y3 in FIG. 13. Accordingly, in the spin-drying cycle, good drainage may be performed although the water through hole is not formed only in the front portion and the rear portion of the drum 4B.

Further, a direction guided by the water guide surface 45*c* may be different for each lifter 45. For example, in some lifters 45, water is guided to the front side by reversing the inclination thereof. Accordingly, because drainage is dispersed, it is possible to effectively discharge water although a small number of holes is formed therein.

Further, in the washing machine 1B, the water through hole 45*d* is formed in the water guide surface 45*c*, and thus water is introduced into the lifter 45. In the lifter 45, the plurality of mounting holes 41*d* used for mounting the lifter 45 is present. Because among these mounting holes 41*d*, the insertion portion 411 is used only for mounting the lifter 45, the other mounting holes 41*d* may function as an opening provided to communicate with the outside of the drum 4B after mounting the lifter 45.

Therefore, the washing machine 1B is configured to discharge water through the water through hole 45*d* and the insertion portion 411. The spin-drying performance may be further improved. It is appropriate that each water through hole 45*d* is alternately arranged on both sides. Accordingly, water introduced into the lifter 45 through the water through hole 45*d* may be easily stored in the lifter 45.

As described above, in the washing machine 1B, to which the technology according to the embodiment is applied, not only water and energy saving but also spin-drying performance are improved. Further, an eco-friendly and high-performance washing machine may be implemented.

<Application Field>

The technology according to the embodiment is also suitable for a washing machine with a drying function. An example of application in a washing and drying machine 100 is illustrated.

The washing and drying machine 100 according to the application example has the same configuration as the washing machine 1A or the washing machine 1B described above, except that a drying device 101 configured to circulate warm air in the drum 4 is provided. That is, as shown by a virtual line in FIG. 4, in the washing and drying machine 100, the drying device 101, which is driven based on the control of the controller 6, is added to the washing machine 1A or 1B described above. Because the configuration of the drying device 101 is a known technology, a detailed description thereof will be omitted.

Figure 15A:
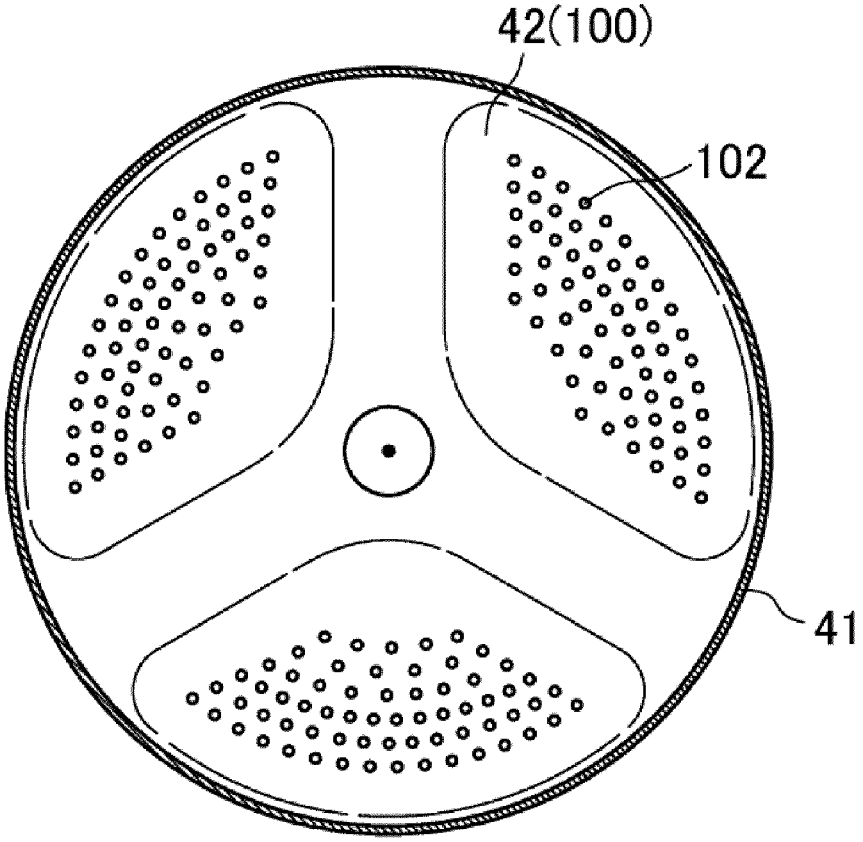
FIG. 15A is a schematic view illustrating a concave portion (a bottom wall of a drum) of a drum type washing machine according to an application.

The drum 4 is configured to perform good drying. FIG. 15A illustrates a bottom wall 42 of the drum 4 of the washing and drying machine 100.

In the drum 4 (appropriately, the drum 4B) of the washing and drying machine 100, a plurality of through-holes (ventilation holes 102) is formed in portions other than an outer periphery and a portion on which a support frame is mounted. A total opening area of the ventilation hole 102 is large, and is set sufficiently larger than the total opening area of the front through hole 47 and the rear through hole 48. Because there is little water in the drum 4, there is no risk of water leakage from the ventilation hole 102 during the washing cycle or the rinsing cycle.

Figure 15B:
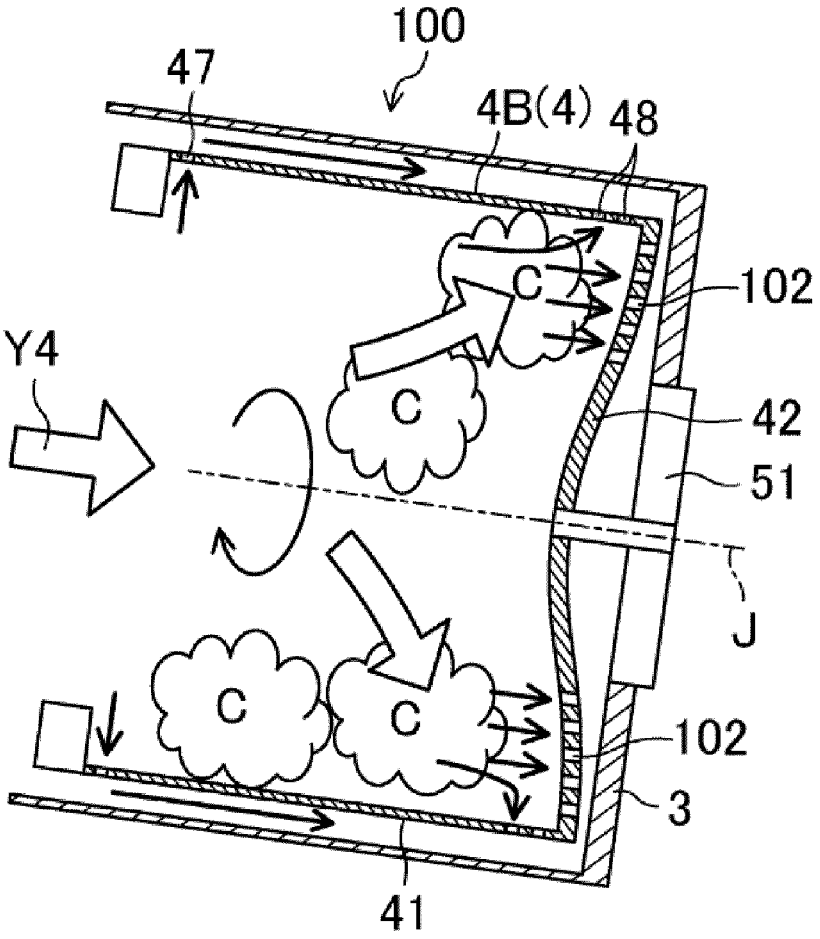
FIG. 15B is a view illustrating a flow of hot air during drying.

In the drying cycle, warm air is introduced into the drum 4 from an opening 44 as indicated by an arrow Y4 in FIG. 15B while the drum 4 is rotated at a low speed. Because a few front through holes 47 is formed at the front end portion of the drum 4, the warm air introduced into the drum 4 flows to the bottom side of the drum 4, particularly, a corner thereof in which the rear through holes 48 and the ventilation holes 102 are opened.

Because the clothes C is raised and lowered by the lifter 45 in a state of being gathered on the bottom of the drum 4, the warm air may be brought into contact with the clothes C efficiently. Therefore, because the clothes C is efficiently dried, a drying time may be reduced and an amount of power consumption may be reduced. Energy saving may be realized more effectively.

The drum-type washing machine according to the technology according to the embodiment is not limited to the above-described embodiment, and includes various other configurations.

For example, in each of the above-described embodiments, the drum type washing machine in which the drum 4 is inclined inside the main body 2 is illustrated, but the drum type washing machine is a type in which the drum 4 is disposed approximately horizontally inside the main body 2. The drain pump may be a drain valve. According to the specifications, the configuration of the second embodiment may be combined with the drum type washing machine of the first embodiment. The configuration of the first embodiment may be combined with the drum type washing machine of the second embodiment.

In the drum-type washing machine according to the second embodiment described above, a straight water flow path is formed by dividing each of the protruding ribs 49 at the same position in the circumferential direction, but the present disclosure is not limited thereto. It is also possible to form a straight water flow path so as to extend obliquely with respect to the axial direction. By dividing each of the protruding ribs 49 at different positions in the circumferential direction, a stair (ladder) type or a lattice type-water flow path may be formed.

That is, it is only required that the front through hole 47 and the rear through hole 48 communicate to each other through the water flow path. The number and location of the water flow path may also be set according to the specifications. The cross-sectional shape and height of the protruding rib 49, and the width of the water flow path may also be set according to specifications.

The front concave groove portion 41*a* or the rear concave groove portion 41*b* is not essential. That is, the front through hole 47 and the rear through hole 48 may be formed on the reference surface of the circumferential wall 41.

In the lifter installation portion 41*c* provided inside the lifter 45, a hole for the water flow may be formed in a range that does not affect the water storage properties of the drum 4B.

Figure 16A:
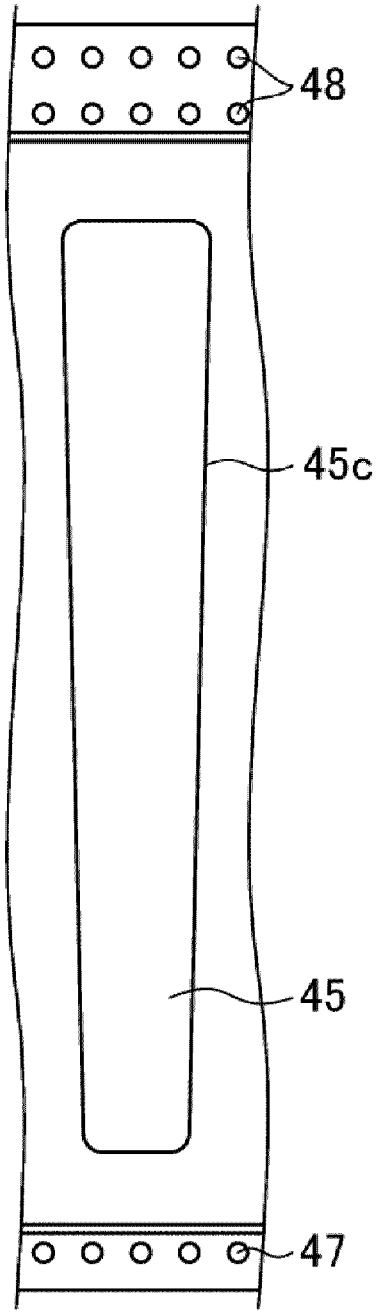
FIGS. 16A to 16C are schematic views illustrating a modified example of the lifter.

In the drum-type washing machine according to the second embodiment described above, the pair of side edges of the flange portion 45*b* of the lifter 45 is inclined to allow a distance between the side edges to increase as it goes forward, but it may be reversed. Particularly, as shown in FIG. 16A, the pair of side edges of the flange portion 45*b* of the lifter 45 may be inclined to allow a distance between the side edges to increase as it goes rearward.

Figure 16B:
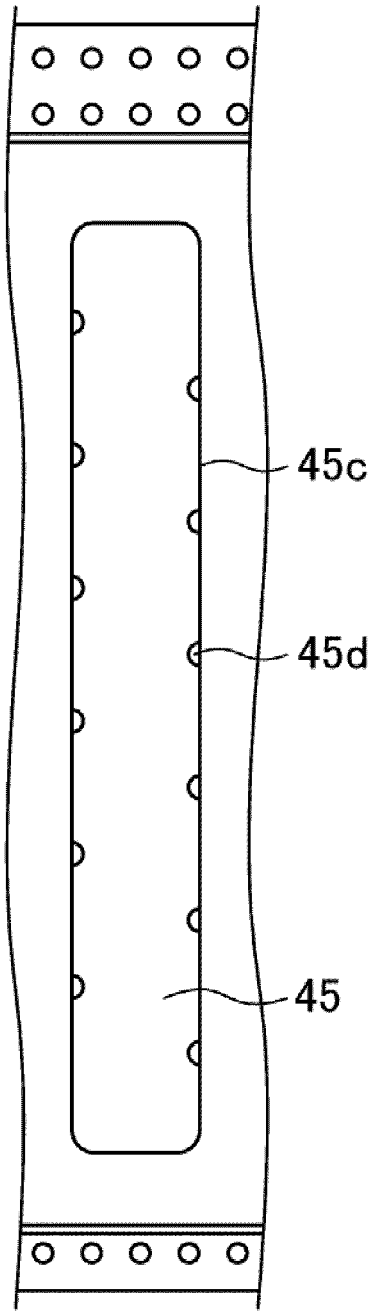

In addition, in the case of forming the water through hole 45*d* in each of the side edges thereof, the pair of side edges of the flange portion 45B of the lifter 45 may be substantially parallel without inclining, as shown in FIG. 16B.

Figure 16C:
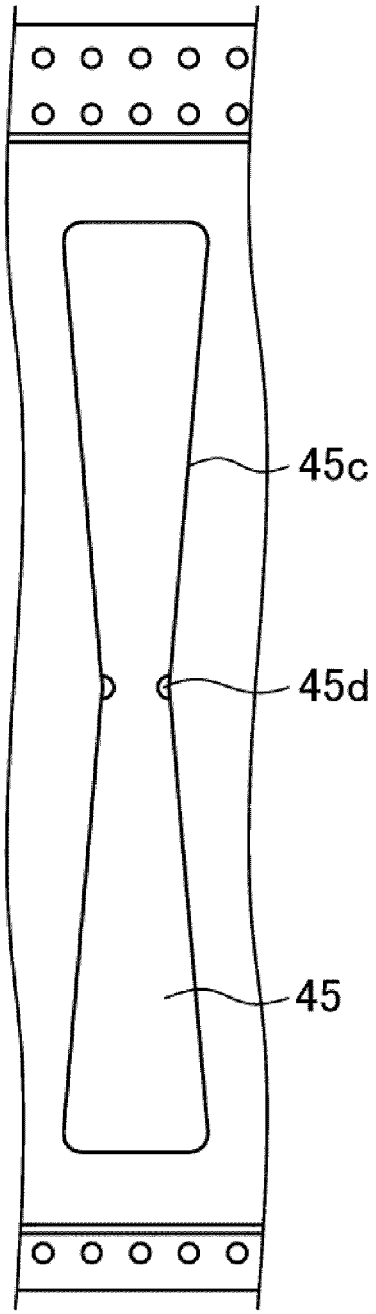

Further, as shown in FIG. 16C, a concave pit is formed in a middle portion in a longitudinal direction of the pair of side edges of the flange portion 45*b* of the lifter 45 to easily receive water, and the water through hole 45*d* is formed on the bottom side of the concave pit. Accordingly, it is possible to actively utilize the water through hole 45*d*.

The invention claimed is:

1. A washing machine comprising:

a main body;

a tub inside the main body;

a drum rotatably disposed in the tub to accommodate laundry, the drum including:

a circumferential wall, a rear concave groove portion at a rear end of the circumferential wall and longitudinally extending in a band shape in a circumferential direction of the drum, rear through holes in the rear concave groove portion, a front concave groove portion at a front end of the circumferential wall and longitudinally extending in a band shape in the circumferential direction of the drum, front through holes in the front concave groove portion, a first plurality of protruding ribs protruding from an inner surface of the circumferential wall and longitudinally extending in the circumferential direction of the drum, and a second plurality of protruding ribs protruding from the inner surface of the circumferential wall and longitudinally extending in the circumferential direction of the drum, so that a water flow path is formed between the first plurality of protruding ribs and the second plurality of protruding ribs along the inner surface of the circumferential wall between the front through holes and the rear through holes;

a sprinkler; and a circulation pump, wherein the tub, the drum, the sprinkler, and the circulation pump are configured so that the circulation pump supplies water stored in the tub to the sprinkler, the sprinkler spays water suppled to the sprinkler by the circulation pump toward laundry accommodated in the tub, and water in the drum flows along the water flow path to the rear through holes to be discharged through the rear through holes to the tub, to be stored in the tub.

2. The washing machine of claim 1, wherein the circumferential wall includes a lifter installation portion, the washing machine further includes a lifter installable in the lifter installation portion so as to protrude from the inner surface of the circumferential wall, and the first plurality of protruding ribs and the second plurality of protruding ribs are positioned so as not to be in or on the lifter installation portion, the front concave groove portion, or the rear concave groove portion.

3. The washing machine of claim 1, wherein:

the first plurality of protruding ribs and the second plurality of protruding ribs are spaced apart from each other in the circumferential direction, so that the water flow path is formed between the first plurality of protruding ribs and the second plurality of protruding ribs along the inner surface of the circumferential wall between the front through holes and the rear through holes, and the water flow path longitudinally extends along an axial direction of the drum.

4. The washing machine of claim 3, wherein an annular flow path is formed along the circumferential direction of the drum between adjacent protruding ribs along the axial direction of the drum of the first plurality of protruding ribs and adjacent protruding rib along the axial direction of the drum of the second plurality of protruding ribs.

5. The washing machine of claim 1, wherein circumferential opposite end surfaces of each protruding rib of the first plurality of protruding ribs and axial opposite end surfaces of each protruding rib of the first plurality of protruding ribs are inclined at a predetermined angle with respect to the inner surface of the circumferential wall, and circumferential opposite end surfaces of each protruding rib of the second plurality of protruding ribs and axial opposite end surfaces of each protruding rib of the second plurality of protruding ribs are inclined at a predetermined angle with respect to the inner surface of the circumferential wall.

6. The washing machine of claim 1, further comprising:

a lifter including a first water guide surface on a first side of the lifter and a second water guide surface on a second side, opposite to the first side, of the lifter, wherein the lifter is installable on the inner surface of the circumferential wall so that the lifter protrudes from the inner surface of the circumferential wall, the lifter is between the first plurality of protruding ribs and the second plurality of protruding ribs, the lifter longitudinally extends in the water flow path, and the first water guide surface and the second water guide surface guide water to the front through holes and/or to the rear through holes via the water flow path.

7. The washing machine of claim 6, wherein the lifter includes a first water through hole on the first water guide surface and a second water guide hole on the second water guide surface to introduce water into the lifter.

8. The washing machine of claim 7, wherein the lifter includes a mounting hook, a mounting hole is on the circumferential wall, the mounting hook is mountable to the mounting hole to mount the lifter on the circumferential wall, and the mounting hole includes an opening to allow water in the lifter to escape to an outside of the drum in a state in which the mounting hook is mounted to the mounting hole.

9. The washing machine of claim 6, wherein the drum further includes a first reinforcing protrusion longitudinally extending in the circumferential direction of the drum and being between a front end portion of the lifter and the front through holes, and a second reinforcing protrusion longitudinally extending in the circumferential direction of the drum and being between a rear portion of the lifter and the rear through holes.

* * * * *